US005110183A

United States Patent [19]

Jeanes, III

[11] Patent Number: 5,110,183

[45] Date of Patent: May 5, 1992

[54] CUSTOMIZED HOME CHAIR AND METHOD OF MANUFACTURE

[75] Inventor: Isaac W. Jeanes, III, 119 Spruce St., Pulaski, Va. 24301

[73] Assignees: Comfy Care, Inc.; Isaac W. Jeanes III, Pulaski, Va. ; a part interest

[21] Appl. No.: 131,648

[22] Filed: Dec. 10, 1987

[51] Int. Cl.[5] ..... A47C 1/032

[52] U.S. Cl. ..... 297/343; 297/75; 297/131; 297/342; 297/377; 297/325; 248/188.5

[58] Field of Search ..... 297/68, 75, 131, 342, 297/343, 325, 377; 248/188.5

[56] References Cited

U.S. PATENT DOCUMENTS

| | | | |
|---|---|---|---|
| 62,395 | 2/1867 | Coats . | |
| 67,362 | 7/1867 | Small . | |
| 331,111 | 11/1885 | Batton | 297/131 |
| 557,614 | 4/1896 | Schmitt | 4/480 |
| 1,186,059 | 6/1916 | Yarrington | 297/68 |
| 1,212,675 | 1/1917 | Pettyjohn | 297/75 |
| 1,246,209 | 11/1917 | Witter | 297/342 |
| 1,421,260 | 6/1922 | Kurnick | 297/68 |
| 1,884,577 | 10/1932 | Comper | 5/463 |
| 2,112,702 | 3/1938 | Loibl . | |
| 2,169,486 | 8/1939 | Dorton | 297/342 |
| 2,377,649 | 6/1945 | Quinney | 297/68 |
| 2,681,454 | 6/1954 | Tallman | 297/68 |
| 2,834,397 | 5/1958 | Kluglein et al. | 297/354 X |
| 2,919,746 | 1/1960 | Fidel | 297/68 |
| 3,081,129 | 3/1963 | Ridder . | |
| 3,111,181 | 11/1963 | Yatich . | |
| 3,186,008 | 6/1965 | Fuller . | |
| 3,345,652 | 10/1967 | Hiraga . | |
| 3,546,950 | 12/1970 | Tinetti . | |
| 3,828,378 | 8/1974 | Flam | 5/345 |
| 3,856,345 | 12/1974 | Beckley . | |
| 3,999,234 | 12/1976 | Regan . | |
| 4,344,649 | 8/1982 | Fleischer | 297/75 |

OTHER PUBLICATIONS

Modern Designers Still Can't Make the Perfect Chair, Doug Stewart, Apr. 1986, Smithsonian.

A Better Technology For Home Health Care, Isaac W. Jeanes III, cites medical studies prior to filing date of application, 1989.

Byte Magazine, Nov. 1983, p. 458. Shows conventional method of disclosing a computer program.

On Making Chairs Comfortable, by Alan Marks from the magazine Fine Woodworking (date unknown), 10 pages.

Humanscale, Henry Dreyfuss Associates, MIT Press, Cambridge, Mass., 3 pages.

*Primary Examiner*—Peter R. Brown

[57] ABSTRACT

A reclining chair that meets requirements of chair design promoting occupant comfort: The chair, suitable for use as a bed, provides a means whereby when the seat moves forwardly, the backrest reclines and vice versa, thereby controlling the position of the center of gravity in all backrest positions, and thereby also maintaining approximately the same seat height in all backrest positions. The chair provides a means for adjustably positioning ground engaging components such as wheel assemblies, rocker arms, and other ground engaging devices to alter seat angle. The rocking function also has therapeutic advantages. The use of wheel assemblies, which may be motorized, permits use as a wheelchair. The chair supports the occupant via a plurality of closely spaced springably supported transverse slats. Such support is designed to provide approximately constant average spring deflection in the backrest, seat, and legrest segments at an intermediate backrest angle. The frame is foldable and of uncluttered and functional appearance. The manner and process of making the chair is described in detail including proportions and techniques as necessary in computer program CHAIR-FIT. The program discloses a process of manufacture for customizing and determines other data related to chair construction and design.

23 Claims, 12 Drawing Sheets

232
238
236
234
170
304
30
40
32
296

291
240
234
236
178
200
170
228
132
30
40
108
32
293
238
232

278
g
f
e
d
c
b
a
280
170
30
282
32
a
b
c
d
e
f
g
108

278
132
170
30
280
40
108
32
282

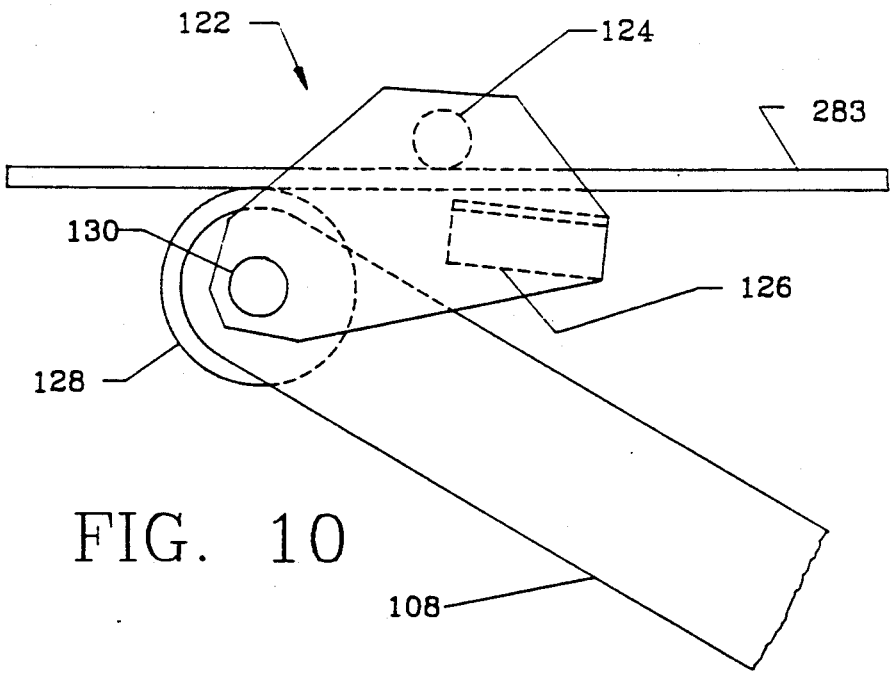
FIG. 10
FIG. 11
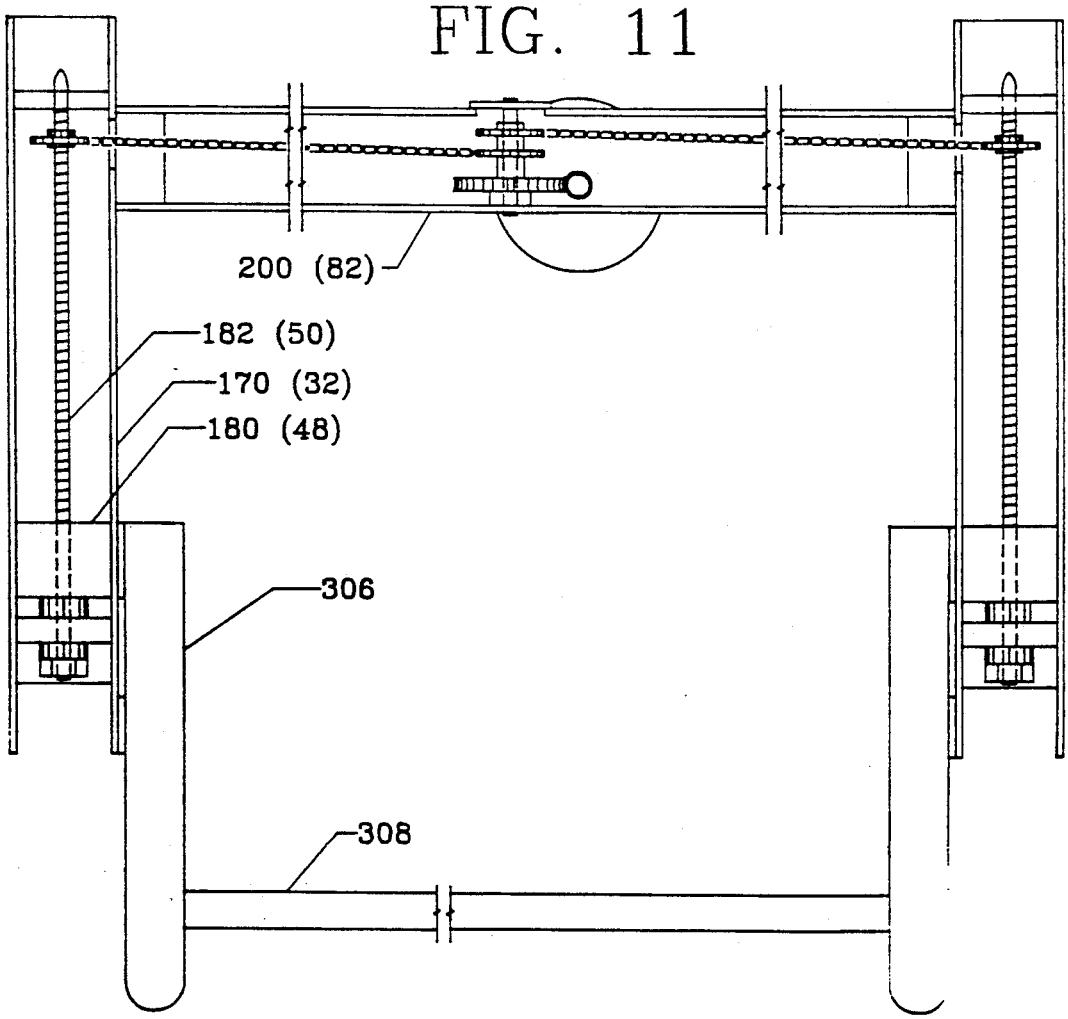

*Fig. 12*

LEGEND TO CHAIRFIT

M(X,DD) MATRIX: 2ND COORDINATE, MNEMONIC, AND SHORT DEFINITION.

| | | |
|---|---|---|
| 0 | TRUNK | TRUNK LENGTH |
| 1 | HEIGHT | BODY HEIGHT |
| 2 | SEAT-L | UNDERSIDE OF THIGH SEATING AREA |
| 3 | B-LEG | LEG, KNEE DOWN - BEFORE ROUNDING OFF |
| 4 | HEAD | NECK AND HEAD LENGTH |
| 5 | ARM | ARMREST MOUNTING POINT OVER OCCUPIED SEAT |
| 6 | SEATPV | SEAT PIVOT ROUNDED OFF |
| 7 | LEG | LEG ROUNDED OFF |
| 8 | B-BACK | BACKREST - BEFORE ROUNDING OFF |
| 9 | BACK | BACKREST ROUNDED OFF |
| 10 | PLAT | PLATFORM ROUNDED OFF |
| 11 | B-PLAT | PLATFORM - BEFORE ROUNDING OFF |
| 12 | WEIGHT | AVERAGE HUMAN WEIGHT |
| 13 | FRAME | LENGTH AT TOP OF TRANSPORT ASSEMBLY |
| 14 | B-MOVE | MOVEMENT TO CENTER OF GRAVITY, BEFORE STANDARDIZING |
| 15 | MOVE | AVERAGE MOVEMENT TO CENTER OF GRAVITY |
| 16 | P-HGTH | HEIGHT TO BOTTOM OF PLATFORM |
| 17 | R-LEG | SHORTENED REAR LEG LENGTH |
| 18 | WHEEL | REAR LEG WHEEL MOUNT LENGTH |
| 19 | L-BACK | LONGEST SUGGESTED BACKREST |
| 20 | L-LEG | LONGEST SUGGESTED LEGREST |
| 21 | LEVER | LEVER LENGTH |
| 22 | MOUNT | LEVER LEG MOUNTING POINT AND CABLE CONNECTING POINT |
| 23 | EXT | LEVER EXTENSION - LEVER LESS MOUNTING POINT |
| 24 | ANGLE | LEVER ANGLE TO HORIZONTAL PLATFORM |
| 25 | OVER | OVERHANG SUPPORTED BY LEVER |
| 26 | F-LEG | FRONT LEG |
| 27 | L-PLAT | PLATFORM WITH LONG LEG AND BACK RESTS |
| 28 | SPR-B | SPRING RATE FOR BACKREST SLATS, LBS./IN. |
| 29 | SPR-S | SPRING RATE FOR SEAT SLATS, LBS./IN. |
| 30 | SPR-L | SPRING RATE FOR LEG SLATS, LBS./IN. |
| 31 | ANG-RET | SEAT ANGLE WITH SHORT REAR LEG |
| 32 | ANG-EXT | ABOVE ANGLE WITH FRONT LEG EXTENDED |

V(X) MATRIX: COORDINATE AND SHORT DEFINITION

| | |
|---|---|
| 1 | LOOP START POINT FOR FRAME |
| 2 | STEP VALUE FOR FRAME |
| 3 | SEAT RANGE ABOVE PREVIOUS VALUE |
| 4 | STEP VALUE FOR SEAT |
| 5 | LOOP START POINT FOR LEG |
| 6 | LEG STEP VALUE |
| 7 | LEG RANGE ABOVE PREVIOUS VALUE |
| 8 | LOOP START POINT FOR BACKREST |
| 9 | STEP VALUE FOR BACKREST |
| 10 | LEG RANGE ABOVE PREVIOUS VALUE |
| 11 | ADDITIONAL THIGH OVERHANG OVER SEAT |
| 12 | FRACTION OF FEMALE USERS |
| 13 | OVERLAP AT SEAT PIVOT TO BACKREST |
| 14 | PLATFORM WEIGHT PER INCH |
| 15 | ON PLATFORM, ADDITIONAL SPACE IN ADDITION TO OCCUPANTS HEIGHT |
| 16 | CONSTANT FOR ADJUSTING CENTER OF GRAVITY BASED ON DIFFERENT BODY TYPES |
| 17 | BOTTOM OF CROSSPIECE TO TOP OF REAR LEG |
| 18 | TOP OF LOWER MOUNTING POINT TO BOTTOM OF LEG |
| 19 | LENGTH OF REAR LEG SLIDE BLOCK |

Fig. 12A

20 SPACE BENEATH RETRACTED WHEEL TO GROUND
21 REAR WHEEL RADIUS
22 FRONT AND REAR LEG WIDTH
23 LEG ANGLE WITH RESPECT TO GROUND, WHEN SEAT HORIZONTAL
24 MINIMUM EXTENSION, LEVER LENGTH LESS MOUNT LENGTH
25 SPACE ON REAR LEG REQUIRED BETWEEN LEVER PIVOT AND BOTTOM OF LEG
26 MAXIMUM LEVER ANGLE
27 AVERAGE SLAT DEFLECTION
28 SLAT WEIGHT PER INCH
29 MOUNTING DISTANCE BETWEEN SLATS
30 LOOP STARTING POINT FOR SEAT
31 ANGLE AT WHICH AVERAGE DEFLECTION IS THE SAME IN LEG, SEAT, AND BACK
32 ANGLE AT WHICH AVERAGE DEFLECTION IS SAME IN LEG, SEAT, AND BACK
33 SIDE MEMBERS HEIGHT - LEG, SEAT, AND BACK
34 ENDING LEVER ANGLE
35 LENGTH FRONT LEG TO BE EXTENDED
36 COORDINATE OF SAMPLE SIZED CHAIR TO ILLUSTRATE LEVER ACTION
37 STARTING POINT FOR STANDARDIZING LEG AND BACKREST
38 ENDING POINT FOR STANDARDIZING LEG AND BACKREST
39 OVERHANG OF SEAT OVER FRAME
40 FLAG TO STANDARDIZE LEG AND BACKREST, WHEN = 1
41 STARTING POINT ADDITIONAL ROUND OF STANDARDIZATION
42 ENDING POINT ADDITIONAL ROUND OF STANDARDIZATION

CHAIRFIT

LINES WITHOUT LINE NUMBERS ARE CONTINUATIONS OF PREVIOUS LINES

```
10 REM PROGRAM WRITTEN IN TECHNICAL SYSTEMS CONSULTANT'S (CHAPEL
20 REM HILL, N.C.) EXTENDED BASIC USED WITH 6809 FLEX (TM) OPERATING
30 REM SYSTEM; TRADEMARK IS PROPERTY OF TECHNICAL SYSTEMS
   CONSULTANTS
40 RD=57.295781:DV=42:DD=32:GOSUB 2600
50 REM PRINTOUT GIVES MNEMONIC AND FIRST COORDINATE IN "M"MATRIX
60  FOR X=0 TO DD:PRINT X;
70  PRINT H$(X);TAB(14);:PRINT:NEXT X
80 DIGITS 6,2:Z2=9
90 DIM S(6,5),P(42,1),Z(4,5),C(15,9),J$(9),V(DV),M(42,DD),Q(Z2,1),
   W(Z2+1,1),K$(Z2)
100 REM *** VARIABLES UNTIL "BODY OF PROGRAM" MAY VARY ***
110 REM    ***************************
120 REM     VARIABLES
130 REM    ***************************
140 REM FOR DATA SEE HENRY DREYFUSS AND ASSOCIATES' HUMANSCALE
150 REM MEASUREMENTS OF 2.5, 50, AND 97.5 PERCENTILE, MALE THEN FEMALE
160  PRINT FRE(0):FOR Y=0 TO 5:FOR X= 1 TO 6:INPUT S(X,Y):NEXT X:NEXT Y
170 REM FROM HUMANSCALE: TRUNK LENGTH FROM CROTCH TO NECK, HEIGHT,
180 REM SEAT LENGTH, LEG LENGTH, NECK AND HEAD LENGTH, ARMREST
   HEIGHT
190 REM DATA 23.8,25.5,27.2,22.1,23.8,25.4
200 REM DATA 63.6,68.6,74,58.7,63.6,68.5
210 REM DATA 17.2,18.8,20.1,15.8,17.7,19.8
220 REM DATA 18,19.7,21.4,16.5,18,19.6
230 REM DATA 10.2,10.8,11.5,9.5,10.2,10.8
240 REM DATA 8.1,9,9.6,7.3,8.1,8.9
250  FOR X=1 TO DV:INPUT V(X):NEXT X
260 REM DATA 30.5,-1,.1,-1,6.5,.75,.25,1,1,.5,0,.565,2.75
```

Fig. 12B

```
270 REM DATA .453,4,1,3.3,2.567,1.187,.075,4,2,65.5,6.25,5.15
280 REM DATA 31.5,.84,.283,1.5,30.5,.94,45,3,27,3.25,11,22,42,.5,2,11,13
290 A$="#####.##":D$="\123456\":C$="####,###":B$="###.#"
300 REM AVERAGE WEIGHTS FROM "THE WORLD ALMANAC 1976" P.964
310 FOR X=1 TO 21:INPUT M(X,12):NEXT X
320 REM DATA 205,199,194,194,189,185,180,175,175,170,168,166
330 REM DATA 163,162,157,153,149,147,147,145,145
340 FOR X=1 TO 21:INPUT M(X+21,12):NEXT X
350 REM DATA 169,164,162,160,160,156,152,148,148,141,140
360 REM DATA 140,136,136,133,130,127,127,127,125,123
370 FOR X=1 TO 9:READ J$(X):NEXT X
380 DATA "SIZE","FEMALE"," MALE","TOTAL"," CUM","SIZE","FEMALE" ,"
    MALE","TOTAL"
390 FOR X=0 TO 21:FOR Y=0 TO 1:INPUT P(X,Y):P(X+21,Y)=P(X,Y)
400 IF X>11 THEN P(X,1)=P(X,1)*-1
410 NEXT Y:NEXT X
420 REM DATA 100,0,99.5,2.576,99,2.326,97.5,1.95,97,1.88,95,1.645,90,1.282
430 REM DATA 80,.84,75,.67,70,.52,60,.218,50,0
440 REM DATA 40,.218,30,.52,25,.67,20,.842,10,1.282,5, 1.65,3,1.88,2.5,1.95
450 REM DATA 1,2.326,.5,2.576
460 REM
470 REM    ****************************
480 REM     BODY OF PROGRAM
490 REM    ****************************
500 REM    *** DEVELOP SIZES ***
510 FOR Y=0 TO 5:Z(1,Y)=(S(2,Y)-S(1,Y))/P(3,1):Z(2,Y)=(S(3,Y)-S(2,Y))/P(3,1)
520 Z(3,Y)=(S(5,Y)-S(4,Y))/P(3,1):Z(4,Y)=(S(6,Y)-S(5,Y))/P(3,1):    NEXT Y
530 FOR Y=0 TO 5:FOR X=1 TO 11
540 M(X,Y)=P(X,1)*Z(2,Y)+S(2,Y):M(X+21,Y)= P(X,1)*Z(4,Y)+S(5,Y):NEXT X
550  FOR X=12 TO 21:M(X,Y)=P(X,1)*Z(1,Y)+S(2,Y)
560 M(X+21,Y)=P(X,1)*Z(3,Y)+S(5,Y):NEXT X:NEXT Y
570 REM    *** SIZES FRAME & PLATFORM PARTS ***
580 FOR X= 1 TO 42:M(X,11)=M(X,1)+V(15):NEXT X
590 FOR X=1 TO 42:FOR Q=V(30) TO 5 STEP V(4)
600  IF M(X,2)-V(31)-V(11)+V(3)>Q THEN M(X,6)=Q:GOTO 620
610 NEXT Q
620 NEXT X
630 FOR X= 1 TO 42:FOR Q=V(1) TO 5 STEP V(2)
640 IF M(X,6)>=Q THEN M(X,13)=Q+V(13)-V(39):GOTO 660
650 NEXT Q
660 NEXT X
670 FOR X=1 TO 42:FOR Q=V(5) TO 40 STEP V(6)
680 IF M(X,3)-V(7)<Q THEN M(X,7)=Q:GOTO 700
690 NEXT Q
700 NEXT X
710 Y5=7:Y6=20:Y7=1:Y8=42:GOSUB 2690
720 Y7=V(37):Y8=V(38):GOSUB 2690
725 Y7=V(41):Y8=V(42):GOSUB 2690
730 FOR X=1 TO 42:M(X,8)=M(X,11)-M(X,6)-M(X,7):NEXT X
740 FOR X=1 TO 42:FOR Q=V(8) TO 50 STEP V(9)
750 IF M(X,8)-V(10)<Q THEN M(X,9)=Q:GOTO 770
760 NEXT Q
770 NEXT X
780 Y5=9:Y6=19:Y7=1:Y8=42:GOSUB 2690
790 Y7=V(37):Y8=V(38):GOSUB 2690
795 Y7=V(41):Y8=V(42):GOSUB 2690
800 IF V(40)=1 THEN FOR X=1 TO 42:M(X,7)=M(X,20): M(X,9)=M(X,19): NEXT
    X
810 FOR X=1 TO 42:M(X,10)=M(X,7)+M(X,9)+M(X,6)
```

Fig. 12C

```
820 M(X,27)=M(X,20)+M(X,19)+M(X,6):NEXT X
830 V=9:Y1=5:Y2=5:Y3=V(9):GOSUB 2610
840 REM    *** CENTER OF GRAVITY ***
850 FOR X=1 TO 21:MD=.096*M(X,12):FD=.077*M(X+21,12)
860 MT=.575*M(X,12):FT=.564*M(X+21,12): MI=MT/M(X,0)*V(16)+V(14)
870 FI=FT/M(X+21,0)*V(16)+V(14):
   ME=MD+(M(X,4)*V(14)):FE=FD+(M(X+21,4) *V(14))
880 MP=(M(X,12)+(M(X,1)*V(14)))/2: FP=(M(X+21,12)+(M(X+21,1)*V(14)))/2
890 MP=MP-ME:FP=FP-FE:MG=MP/MI+M(X,4): FG=FP/FI+M(X+21,4)
900 MG=(M(X,10)-M(X,1))/2+MG:FG=(M(X+21,10)-M(X+21,1))/2+FG
910 M(X,14)=M(X,13)/2+M(X,9)-V(13)-MG
920 M(X+21,14)=M(X+21,13)/2+M(X+21,9)-V(13)-FG:NEXT X
930 V=13:Y1=14:Y2=15:Y3=V(2)*-1:GOSUB 2610
940 REM    *** PLATFORM HEIGHT ***
950 FOR X=1 TO 42:M(X,16)=SIN(V(23)/RD)*M(X,20):NEXT X
960 REM    *** REAR AND FRONT LEG LENGTH & WHEEL MOUNT ***
970 FOR X=1 TO 42
980 MV=(M(X,16)-((V(17)+V(18)+V(19))*SIN(V(23)/RD))-
   (V(21)*((1/SIN(V(23)/RD)-1))*SIN(V(23)/RD))+V(20))/2
990 M(X,18)=MV+V(19)+V(18):M(X,17)=MV+V(17)+V(18)+V(19)
1000 M(X,26)=M(X,16)/SIN(V(23)/RD)-(TAN((90-V(23))/RD)*V(22)): NEXT X
1010 REM    *** LEVER LENGTH ***
1020 V=13:GOSUB 2110
1030 FOR Q=L1 TO L2:FOR X=1 TO 42
1040 IF M(X,13)=Q AND M(X,21)=0 THEN GOSUB 2320
1050 NEXT X:NEXT Q
1060 REM ***% USED BY BOTH SEXES & % MANUFACTURED ***
1070 G3=0:FOR V1=1 TO 4:IF V1=1 THEN S=V(6):V=7
1080 IF V1=2 THEN S=V(4)*-1:V=6
1090 IF V1=3 THEN S=V(9):V=9
1100 IF V1=4 THEN S=V(2)*-1:V=13
1110 IF V1=2 THEN G4=V(13)+V(33) ELSE G4=0
1120 GOSUB 2110
1130 FOR X=0 TO 15:FOR Y=0 TO 9:C(X,Y)=0:NEXT Y:NEXT X
1140 X=0:FOR N=L2 TO L1 STEP S*-1:X=X+1:C(X,1)=N: C(X,6)=N:NEXT N
1150 A=0:B=0:FOR X=1 TO 21:IF X=21 THEN A=A+.5:B=B+.5
1160 P1=P(X-1,0)-P(X,0):A=P1+A:B=P1+B:IF X=21 OR M(X,V)<>M(X+1,V)
   THEN GOSUB 2230
1170 IF X=21 THEN 1200
1180 IF X=21 OR M(X+21,V)<>M(X+22,V) THEN GOSUB 2270
1190 NEXT X
1200 GOSUB 2270
1210 FOR X=1 TO 15:C(X,4)=(V(12)*C(X,2))+((1-V(12))*C(X,3))
   :C(X,9)=C(X,4):NEXT X
1220 FL=0:FOR X=1 TO 14:IF C(X,4)<C(X+1,4) THEN GOSUB 2310
1230 NEXT X
1240 IF FL>0 THEN 1220
1250 GOSUB 2150
1260 FOR X=1 TO 15:IF C(X,4)>0 THEN G3=(C(X,4)*(C(X,1))+G4)+G3 :NEXT X
1270 IF V=9 THEN PRINT "FEET OF STRUCTURAL ANGLE PER 100 UNITS:" :PRINT
   USING C$,G3/6:PRINT
1280 NEXT V1
1290 REM ***** SPRING DEFLECTION ********
1300 FOR X=1 TO Z2
1310 READ K$(X)
1320 FOR Y=0 TO 1
1330 READ Q(X,Y):NEXT Y
1340 NEXT X
1350 DATA "HEAD",7.1,5.7,"NECK",2.5,2,"TRUNK",45.8,46.3
```

Fig. 12D

```
1360 DATA "UPPER ARM",6.6,6,"FOREARM",3.8,3.1,"HAND",1.3,1
1370 DATA "THIGH",21,23,"LEG",9,10.5,"FEET",2.9,2.4
1380 FOR Y=1 TO 42
1390  HH=Y:Z1=0:Q1=0:IF Y>21 THEN Q1=1
1400  FOR X=1 TO Z2
1410   W(X,Q1)=Q(X,Q1)*M(Y,12)/100:Z1=Z1+W(X,Q1)
1420   IF X=6 THEN W(Z2+1,Q1)=Z1
1430  NEXT X
1440  X=V(32):GOSUB 2000
1450  M(Y,28)=L1/V(27):M(Y,29)=L2/V(27):M(Y,30)=L3/V(27)
1460 NEXT Y
1470 FOR Y=0 TO 1
1480   HH=Y*21+11:K=0:A=0:Q=32:T=3:A2$="####.#":A1$="\1234\"
1490   B2$="##":B1$="\1\":C$="###":C1$="\12\":D2$="##.##": D1$="\123\"
   :Z1=0:PRINT DATE$
1500   FOR X=1 TO Z2
1510    PRINT X,K$(X),:W(X,Y)=Q(X,Y)*M(HH,12)/100: Z1=Z1+W(X,Y)
1520    IF X=6 THEN W(Z2+1,Y)=Z1
1530    PRINT USING A2$,W(X,Y)
1540   NEXT X
1550   PRINT TAB(Q);:PRINT USING A2$,Z1:T1=50:T2=58:T3=68
1560   FOR J=1 TO 8
1570   PRINT:QQ=5:QQ=10
1580   FOR X=90 TO 0 STEP -QQ
1590    IF X<50 AND X>=35 THEN X=X+(QQ/2)
1600    PRINT USING B2$,X;:PRINT " ";:PRINT USING C$,180-X;
1610    B=0:F=0:GOSUB 2000
1620    PRINT USING A2$,K1;:PRINT USING A2$,A;
1630    PRINT USING A2$,C-B;B;D;E;F;:PRINT SPC(T); :PRINT USING
   D2$,L1/M(HH,28);
1640    PRINT "   ";:PRINT USING D2$,L2/M(HH,29);
1650    PRINT "   ";:PRINT USING D2$,L3/M(HH,30);:PRINT:NEXT X
1660  PRINT:PRINT:NEXT Y
1670 REM *** SEAT ANGLE AS REAR LEG SHORTENED AND FRONT LEG
   LENGTHENED
1680 QQ=TAN((90-V(23))/RD)*V(22)
1690 FOR ZZ=1 TO 42
1700  Q1=V(22)/SIN(V(23)/RD):B=M(ZZ,13)-(2*Q1)
1710  C=M(ZZ,17)+QQ:Z=C:B1=M(ZZ,26)+QQ
1720  AA=180-V(23):GOSUB 2070
1730  M(ZZ,31)=V(23)-A1:B1=V(35)+B1:GOSUB 2070
1740  M(ZZ,32)=V(23)-A1:REM ANGLE WITH EXTENDED & RETRACTED LEG
1750 NEXT ZZ
1760 REM *** ROUTINE TO SIMULATE LEVER ONLY, NOT EXACT ***
1770 ZZ=V(36):W1=.75/SIN(V(23)/RD):VT=SIN(V(23)/RD)*M(ZZ,22)
1780 AB=COS(V(23)/RD)*M(ZZ,22):TT=V(13)+M(ZZ,14)+W1+AB
1790 PRINT "M","A2","V3","H2","LV" :S=.25
1800 FOR M=0 TO M(ZZ,14) STEP S
1810  T1=M(ZZ,15)-M:CA=(M(ZZ,22)^2*2 -(M(ZZ,15)-M)^2)/(M(ZZ,22)^2*2)
1820  AA=SQR(1-(CA^2))/CA:AA=RD*ATN(AA):AL=180-V(23)-AA
1830  V2=SIN(AL/RD)*M(ZZ,21):H1=COS(AL/RD)*M(ZZ,21)
1840  H2=TT-M+H1:V3=V2-VT:A2=RD*ATN(V3/H2)
1850  PRINT M,A2,V3,H2,H2/COS(A2/RD):NEXT M
1860 REM    *** PRINT, TRANSFER TO DISK, SORT ***
1880 GOSUB 2490
1890 CLOSE1:OPEN "METHOD" AS 1
1900 DIM #1, N(42,DD)
1910 GOSUB 2590
1920  FL=0:FOR X=1 TO 42:IF M(X-1,1)>M(X,1) THEN GOSUB 2580
```

Fig. 12E

```
1930 NEXT X
1940 IF FL>0 THEN 1920
1950 GOSUB 2490
1960 CLOSE 1:END
1970 REM   ***************************
1980 REM    SUBROUTINES
1990 REM   ***************************
2000 IF X<V(23) THEN XX=X ELSE XX=V(23)
2010 F=SIN(XX/RD)*5.77*M(HH,12)/100
2020 B=SIN(X/RD)*7.5*M(HH,12)/100:Q1=0:IF HH>21 THEN Q1=1
2030 C=W(Z2+1,Q1)*SIN(X/RD):K=A:A=W(Z2+1,Q1)*COS(X/RD)
2040 K1=A-K:A1=A-C:D=W(7,Q1)+C-B-F: E=W(8,Q1)+W(9,Q1)*COS(XX/RD)
2050 L1=((A/M(HH,0))+V(28))*V(29)/2: L2=((D/M(HH,2))+V(28))*V(29)/2
2060 L3=((E/M(HH,3))+V(28))*V(29)/2:RETURN
2070 A=SQR(B^2+C^2-(2*B*C*COS(AA/RD))): SC=(C*SIN(AA/RD))/A
   :X1=SC/SQR(1-(SC^2))
2080 X1=RD*ATN(X1):C1=SQR(B1^2+A^2-(2*B1*A*COS((AA-X1)/RD)))
2090 SA=(A*SIN((AA-X1)/RD))/C1:A1=SA/SQR(1-(SA^2)):A1=RD*ATN(A1)
2100 RETURN
2110 Y7=1:Y8=42
2120 L1=999999:L2=0:FOR X=Y7 TO Y8:IF M(X,V)<L1 THEN L1=M(X,V)
2130 IF M(X,V)>L2 THEN L2=M(X,V)
2140 NEXT X:RETURN
2150 PRINT DATE$;TAB(35);H$(V):PRINT:F=0:PRINT "   ";
2160  FOR Y=1 TO 9:PRINT USING D$,J$(Y);:IF Y=5 THEN PRINT "   ";
2170  IF Y=5 THEN PRINT SPC(4);
2180 NEXT Y:PRINT
2190 FOR X=1 TO 15:FOR Y=1 TO 9:IF Y=5 THEN F=F+C(X,4):C(X,5)=F
2200  IF C(X,1)>0 THEN PRINT USING A$,C(X,Y); :IF Y=5 THEN PRINT USING
   "###",X;
2210  IF Y=5 THEN PRINT SPC(4);
2220 NEXT Y:PRINT:NEXT X:RETURN
2230 FOR X1=1 TO 15
2240  IF M(X,V)=C(X1,1) THEN C(X1,3)=C(X1,3)+A:A=0:C(X1,8)=C(X1,3) :GOTO
   2260
2250 NEXT X1
2260 RETURN
2270 FOR X1=1 TO 15
2280  IF M(X+21,V)=C(X1,1) THEN C(X1,2)=C(X1,2)+B:B=0: C(X1,7)=C(X1,2)
   :GOTO 2300
2290 NEXT X1
2300 RETURN
2310 FOR Y=1 TO 4:SWAP C(X,Y),C(X+1,Y):NEXT Y: FL=1:RETURN
2320 Z1=-.0625:FOR A1=V(26) TO V(34) STEP Z1
2330  MP=(M(X,15)/2)/COS(((V(23)+A1)/2)/RD): LV=(MP/SIN(A1/RD))
   *SIN(V(23)/RD)
2340  HG=(MP/SIN(A1/RD))*SIN((180-V(23)-A1)/RD)
2350  IF M(X,20)+M(X,15)+1.5<HG THEN 2390
2360  IF M(X,17)-V(25)<MP THEN 2380
2370  IF LV-MP>V(24) THEN 2390
2380 NEXT A1
2390 FOR K=1 TO 42
2400  IF M(K,13)=Q THEN M(K,21)=LV:M(K,22)=MP:M(K,23)=LV-MP:
   M(K,24)=A1 :M(K,25)=HG
2410 NEXT K:RETURN
2420 IF Z=1 THEN F=12:RESTORE 2550
2430 IF Z=2 THEN F=8:RESTORE 2560
2440 IF Z=3 THEN F=13:RESTORE 2570
2450 RETURN
```

*Fig. 12F*

```
2460 IF X=22 THEN PRINT
2470 PRINT USING B$,P(X,0);:G1=INT(M(X,1)/12):G2=M(X,1)-(12*G1)
2480 PRINT USING "###",G1;:PRINT "'";:PRINT USING "##.#",G2;: RETURN
2490 Z1=3:FOR Z=1 TO Z1:PRINT DATE$:PRINT TAB(16);:GOSUB 2420
2500  FOR V1=1 TO F:READ V:PRINT USING D$,H$(V);:NEXT V1: PRINT:PRINT
2510  FOR X=1 TO 42:GOSUB 2460
2520  GOSUB 2420
2530  FOR V1=1 TO F:READ V:PRINT USING A$,M(X,V);:NEXT V1: PRINT :NEXT
   X:PRINT:PRINT:NEXT Z:RETURN
2540 REM ITEMS TO PRINT CONTROLLED BY "RESTORE"
2550 DATA 12,13,7,6,9,10,27,20,19,28,29,30
2560 DATA 1,0,2,3,4,8,11,14
2570 DATA 16,18,15,21,22,23,24,25,31,32,26,17,5
2580  FOR Y=1 TO DD:SWAP M(X-1,Y),M(X,Y):NEXT Y:SWAP P(X-1,0),P(X,0)
   :FL=1:RETURN
2590  FOR X=0 TO 42:FOR Y=0 TO DD:N(X,Y)=M(X,Y):NEXT Y: NEXT X:CLOSE 1
2600 OPEN "HEADING" AS 1:DIM #1, H$(DD+1)=8:H$(DD+1)=" ": RETURN
2610 GOSUB 2110
2620 FOR Q=L1 TO L2 STEP Y3:F=0:G=0:FOR X=1 TO 42
2630  IF M(X,V)=Q THEN G=G+M(X,Y1):F=F+1
2640 NEXT X
2650 IF F=0 THEN 2680
2660  G=G/F:FOR X=1 TO 42:IF M(X,V)=Q THEN M(X,Y2)=G
2670 NEXT X
2680 NEXT Q:RETURN
2690 V=13:GOSUB 2120
2700 FOR Q=L1 TO L2 STEP V(2)*-1:L2=0:FOR X=Y7 TO Y8
2710  IF M(X,V)=Q AND M(X,Y5)>L2 THEN L2=M(X,Y5)
2720 NEXT X
2730  FOR X=Y7 TO Y8:IF M(X,V)=Q THEN M(X,Y6)=L2
2740 NEXT X:NEXT Q:RETURN
```

CUSTOMIZED HOME CHAIR AND METHOD OF MANUFACTURE

FIELD OF INVENTION

This invention relates to a reclining chair for the infirm, meeting requirements of good chair design, having the capacity to alter seat angle, and suitable for use as a bed, wherein as the set moves forwardly the backrest recline; this invention additionally relates to a process for manufacturing such a device.

BACKGROUND OF THE INVENTION

Too frequently acquiescing to poor chair design results in discomfort and undesirable, if not debilitating, back and muscle pain. The situation is exacerbated in the case of the infirm who must spend prolonged periods in beds or chairs ill suited to their needs for comfort, mobility, and motion. The object of the present invention is to meet these needs.

The present invention distinguishes itself from prior art in the following areas: meeting criteria for good chair design, customization to fit users of both sexes, use of a 3rd class level to raise and lower backrest responding to seat movement, having the capacity to be folded and disassembled, providing a customized surface that contours to the occupant, and providing use of various ground engaging components, including rockers, to alter seat angle.

Henry Dreyfuss Associates and Dr. Janet Travell have specified characteristics of good chair design and compiled anthropometric data to support such design. Their studies and a summary thereof by Alan marks reveal:

1) A contoured seat even if it faithfully reproduced body shape is not comfortable. The smallest shift in position causes misalignment. The most comfortable contour is the ever changing one made by the sitter adjusting position on a cushioned surface. A way to deal with fatigue is to allow for movement rather than locking muscles into a single, tiring position.

2) If seat angle is less than 15 degrees and the backrest angle is more than 120 degrees, then the body tends to slide forward causing discomfort.

3) An excessively long seat comes in contact with the back of the leg and forces the occupant to slide forward away from the backrest resulting in discomfort. High seat pressure at the seat front edge slows blood circulation to the legs and causes undue pressure on nerves in the thigh. Too short a seat length, though, fails to provide adequate seat support under the thighs. Load on other tissues consequently increases.

4) A backrest that fails to maintain the natural curvature of the back induces backaches.

Prior art indicates that reclining chairs for the infirm, particularly those serving as beds, do not meet Dreyfuss' and Travell's requirements for good chair design. In particular they usually do not provide a variety of seat inclinations approaching 15 degrees, and thus are inherently uncomfortable and unsuited for prolonged occupancy in the chair-like position.

In the bed-like position the utility of such chairs is frequently diminished because: 1) they provide discontinuous support in the leg, seat, or back regions, and/or 2) they elevate chair level from the usual sitting level to a very high and inconvenient position corresponding to a hospital stretcher.

As distinguished from the common chair, a chair converting into a bed must support all principal body segments (leg, seat, and back) in a wide variety of positions. Its elements must consequently hinge at points conforming with precision to the length of the particular occupant's body segments. The need for a custom fit is a point on which the utility of the chair depends. Without a custom fit, it will be uncomfortable and unsuitable for prolonged occupancy. In so far as I am aware, prior art does not reveal a systematic inventive concept: 1) to meet the above requirements for a custom fit in reclining chairs used also as beds, or 2) to disclose a process for manufacturing chairs so designed.

Anatomical differences between men and women are sufficient to challenge customization. Using the technique of linear regression analysis, I found that where "x" is body height and "y" is lower leg length, the formula $0.3174 \times -2,1298 = y$ explained the relationship between height and leg length of a typical sample of males and females with a correlation coefficient of 99.97%. However, no such singular accurate formula appeared to explain the relationship between heights and seat lengths. Women tend to have a longer seat length than men of equal height and consequently also require a shorter backrest. Additionally mature females are on average 5 inches shorter than males. Females currently comprise 64.4% of the population using wheelchairs.

The implications for customizing chairs convertible to beds are that: 1) separate male and female Tables must be used to suggest appropriate back, seat, and leg segment lengths, and 2) that the process of manufacture must separately anticipate the quantities of chair segments of discrete sizes required by males and females. The process revealed in the computer program "CHAIRFIT" constitutes a part of the invention and performs these functions.

Lowering and raising the backrest is accomplished by a lever mounted at a fixed point on the back member in many reclining chairs. The present invention, however, employs a 3rd class lever pivotally connected to the frame and sliding on the backrest to raise the backrest. U.S. Pat. No. 3,111,181 discloses a bell crank mounted on the frame which lowers the backrest when the seat moves forward and raises it when it moves rearward. The bell crank is actuated by linkage arms in compression, requiring great strength in the linkage. In the present invention it is common for the seat to move 8.5 to 11.5 inches to locate center of gravity equidistantly between wheels. A bell crank responding to such movement would require two arms. The lower arm's length would minimally exceed 8.5 to 11.5 inches. Such design is characterized by large amounts of space, great weight, and diminished strength and stability.

The present invention is designed so that the backrest and legrest segments may be easily detached from the seat, so that rear legs retract, so that the legs fold on the underside of the frame, and so that the seat may be conveniently detached from the frame if desired. The method of folding the frame is devised such that wheelchair wheels are substantially contained within the folded device and so that wheels do not interfere with motors and supporting devices. Prior art relating to longitudinally folding a seat along is disclosed in U.S. Pat. No. 3,856,345.

The present invention supports the occupant by means of a plurality of adjacent transverse wood-like slats supported by coil compression springs at opposite ends. The program CHAIRFIT determines discrete spring rates for backrest, seat, and legrest such that at an intermediate backrest angel, approximately constant average spring deflection occurs in those three segments. The resulting customized surface contours to body shape, yet accommodates body movement and changing position. Springs and slats have been disclosed for use on beds for a long time, but the method was primitive and has fallen into disuse. It is believed that the prior art does not reveal a method for contouring slats to a chair occupant in a variety of positions. The following U.S. Pat. Nos. are representative of the prior art; U.S. Pat. Nos. 62,395; 67,362; 2,112,702; 3,081,129 and 3,999,234.

The present invention may be used as a rocking chair have been prescribed for presidents Kennedy and Johnson as an adjunct to managing musculoskeletal pain. A joint study by Eastern Virginia Graduate School of Medicine and the Medical College of Virginia supports the conclusion that self sustained rocking chair ventilation can be used in respiratory muscle failure as an alternative to continuous mechanical ventilation. A patient tends to synchronize breathing to the frequency of the rocking motion. Benefits of rockers previously cited include: increased post-treatment Ference's Human Field Motion Test scores, improved restedness based on Smith's Restedness/Tiredness scale, facilitated equilibrium, increased kinesthetic awareness, reduced blood stasis in the lower limbs, reduced constipation, reduced bed sores, dissipated tension, physical therapy, and reduced insomnia.

A further advantage revealed in the present invention is that when a rocker is pivotally attached to a short rear leg and adjustably moved downward at the point at which it is attached to the front leg, seat angle is increased by a substantially greater amount than if the front leg had been equally extended. Altering seat angle by adjusting the rocker arm becomes the preferred method in the present invention. In so far as I am aware prior art does not disclose such use of a rocker.

The individual advantages of the invention constitute significant advances over prior art. Additionally in combination these advantages are synergetic. The infirm and disabled should benefit greatly from its use. It is sufficiently comfortable and has such a wide range of functions that it is fully anticipated that it will also be used by healthy people.

SUMMARY OF THE INVENTION

Accordingly the following objects and advantages of the invention are claimed:

Under motorized control the backrest is infinitely adjustable to all positions from the upright to the substantially horizontal and movement between positions is smoothly achieved. The device comfortably supports the occupant in all these positions and meets Dreyfuss' and Travell's requirements for good chair design. The range of positions available, including the horizontal, contributes to relaxation and encourages the all important advantages of changing body position. The range of seat angles produced by extending or retracting front or rear leg ground engaging components contributes significantly to occupant comfort.

In this invention it is found that contrary to popular understanding, it is possible to mass produce customized chairs. The program CHAIRFIT makes such mass produced customization possible. The program evolves from the fact that human heights closely approximate the Gaussian curve. For this reason it is possible to generalize with accuracy primarily from the 30 pieces of anthropometric data contained in program lines 190–230 into a system: 1) for determining the required number of discretely sized segments needed in manufacturing. 2) for customizing chair segment lengths, and 3) for determining other necessary component measurements. This process is singularly suited for predicting quantities of discretely sized chair parts but, for example, would be unsuitable for customizing clothes which are highly dependent on weights, thicknesses and girths. Such measurements do not conform to the Gaussian curve and are not correlated with height.

For chairs of various sizes the program CHAIRFIT discloses the process for determining seat movement required to control position of center of gravity in the horizontal position. The reader is cautioned that the manner and process of making the chair requires careful computation of seat movement to ensure the safety of the device. Additionally, mounting points and lever lengths that can be used with a chair fall within a very limited range. These and other necessary computations related to the manner and process of making the chair are disclosed in CHAIRFIT.

All adjustments are made by motorized control. All controls can be performed by the occupant, thus minimizing the need for nursing care. In those cases where nursing care is required, the burden on the nurse is considerably reduced by the many of functions that the chair performs. It is anticipated that the chair will be of great use for home health care.

The legrest, seat, and backrest are easily detached and the legs are foldable under the frame. Divided into the above component parts, the device is of such size and weight that it can be readily shipped by private parcel services or the U.S. Postal Service. Usually components can be shipped in two containers. To be able to ship a bed sized device in such a manner is of great advantage to the user, manufacturer, marketer, service center, and rental facility. Similarly advantages in storage, handling, and customization are great.

Dr. Travell has indicated that constantly changing position prevents resting muscles from building up tension that inevitably occurs when one stays motionless for a sustained period. In the present invention, a multiplicity of narrow slats creates a "fingering effect" as if the body were supported by a multitude of fingers. This permits the body to flex and change position at will, thus diminishing the possibility of building up tension. Clearly the rocking function of the chair also accomplishes such changing of position.

A third class lever is understood to be a lever in which the power is between the resistance and the fulcrum. The design features a 3rd class lever supporting the backrest and linkably connected to the seat such that as the seat moves forwardly the backrest reclines and such that as the seat moves rearwardly the lever raises the backrest. In the last few inches of rearward seat movement, the backrest rises quickly, thus the device rapidly assumes chair-like form. This has the advantage of serving as an attractive though utilitarian piece of furniture. There is a psycho-social advantage in having such a device closely resembling home furnishings. The patient is more content and focus is diverted from a medical device-like environment.

The frame has been designed so as to allow the use of a commode mechanism to be located under the seat. Though the bed pan/commode mechanism does not constitute a portion of this invention, the method of frame construction accommodating to its use does. The use of a toilet device, either bed pan or marine-like electric commode, on such a chair thus greatly increases the chair's utility for many disabled individuals.

Readers will find further objects and advantages from a consideration of the previously stated background of the invention, the ensuing description, the program CHAIRFIT, and the accompanying drawings.

BRIEF DESCRIPTION OF THE DRAWINGS

FIG. 10 is a cut away side view of the lever brake prior to engagement showing positioning of protrusions with respect t back member.

FIG. 11 is a view of ground engaging member adjustably connected to leg assembly.

FIGS. 12, 12A–12B are together a listing of computer program CHAIRFIT.

DRAWING REFERENCE NUMBERS AND PART NAMES

Figures 1, 2, 3, 4:
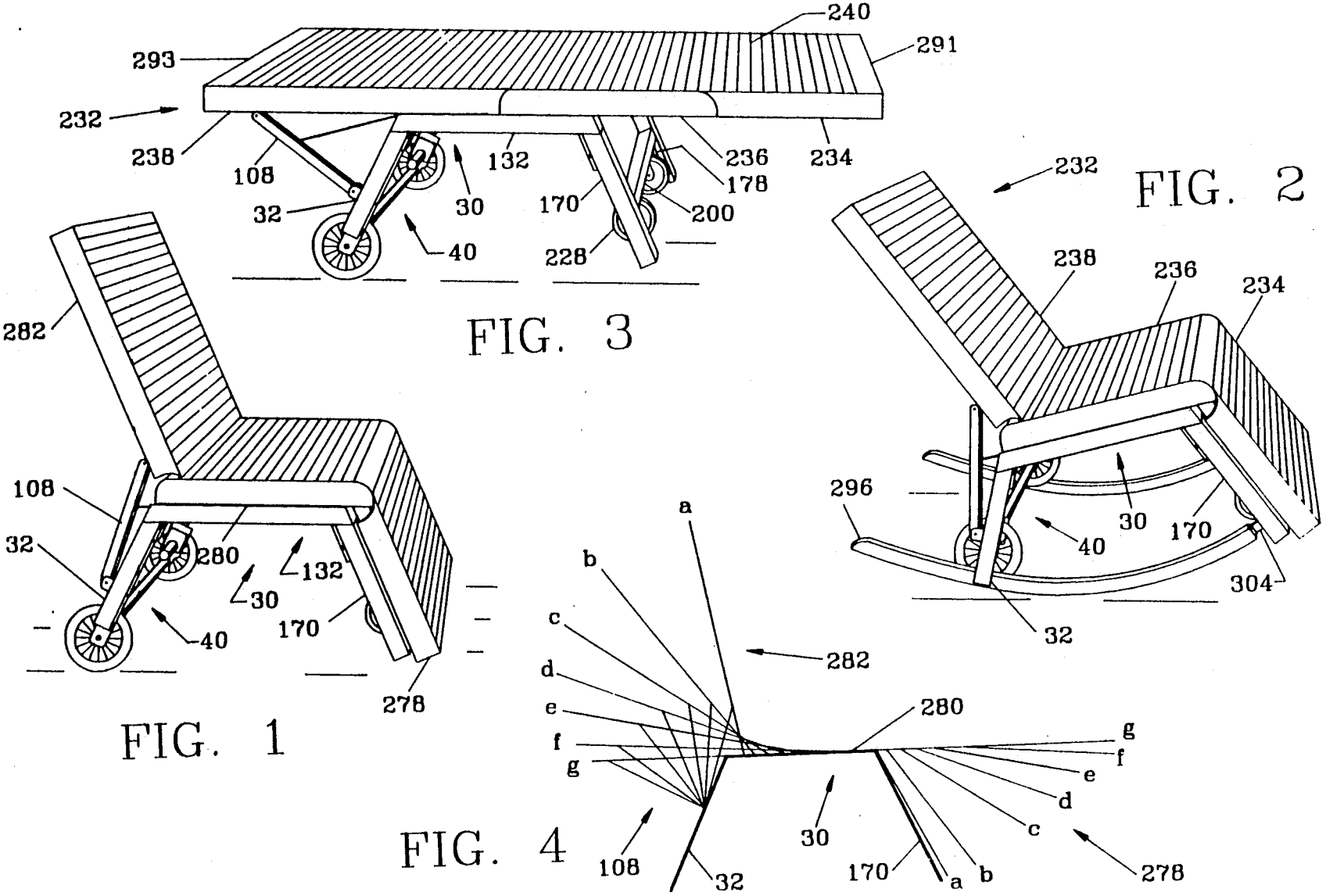
FIG. 1 is a perspective side view of the chair with rear wheel extended.
FIG. 2 is a perspective side view of the chair of FIG. 1 in a rocking configuration, with front rocker arm extended and wheel assembly retracted.
FIG. 3 is a perspective side view of the chair in the horizontal position.
FIG. 4 shows a kinematic stick drawing of changing back, seat, and legrest positions at equal intervals of seat movement.

The following is a list drawing reference numbers and part names separated by semicolons:

30 frame (32, 132 170).

32 rear leg (32–130); 34 lower hinge section for 32;

36 upper hinge section of 32; 35 pivot between upper 36 and lower hinge sections; 40 wheel assembly of 32; 42 wheel of 40;

43 wheel motor and gear reducer of 40; 44 crosspiece of 40; 46 slot in 32;

48 slide block for 32; 50 threaded shaft for 32; 52 retaining nut of 50;

54 thrust bearing for 50; 56 lower mounting block for 50; 58 collar of 50;

64 chain sprocket of 50; 66 rocker slot/aperture in 32; 68 pulley in 36;

70 cable slot in 32; 72 upper mounting block for 50; 74 pulley cap for 32;

76 internally threaded axle for 32; 78 stabilizing screw for 76;

80 pulley for 74; 82 crosspiece for 32; 84 crosspiece insert for 32;

86 cover plate for 82; 90 reversible motor of 82; 92 worm of 90;

94 axle of 82; 98 lower sprocket of 94; 100 upper sprocket of 94;

102 worm gear of 94; 104 chain left for 82; 106 chain right for 82;

108 lever of 32; 110 mounting block for 108; 112 pivot point of 110;

114 connecting block of 108; 118 cable to 108; 122 brake of 108;

124 upper brake protrusion of 122; 126 lower brake protrusion of 122;

128 roller for 108; 130 axle for 128.

132 transport and support assembly (132–168); 134 inside plate of 132;

136 outside plate of 132; 138 threaded shaft for 132;

140 slotted shaft nut of 138; 142 thrust bearing for 138;

144 rear mounting block for 138; 146 spacer for 138; 148 worm gear for 138;

150 reversible motor of 132; 152 worm of 150; 154 sprocket of 138;

158 chain for 154; 160 small rollers of 132; 162 seat block within 132;

164 front mounting block for 138; 166 pulley in 164; 168 support block of 132.

170 front leg (170–230); 172 lower hinge section for 170;

174 upper hinge section of 170; 173 pivot between upper 174 and lower 172 hinge sections; 178 slot in 170; 180 slide block for 170;

182 threaded shaft for 170; 184 retaining nut of 182;

186 thrust bearing for 182; 188 lower mounting block for 182;

190 collar of 182; 196 chain sprocket of 182;

198 upper mounting block for 182; 200 crosspiece for 170;

202 crosspiece insert for 170; 204 cover plate for 200;

208 reversible motor of 200; 210 worm of 208; 212 axle of 200;

216 lower sprocket of 212; 218 upper sprocket of 212; 220 worm gear of 212;

222 chain right for 200; 224 chain left for 200; 226 caster mount of 200;

228 caster for 226; 230 stabilizing screw for 170.

232 platform comprising 234, 236, 238 240; 234 legrest; 236 seat;

238 backrest; 240 slat of 232; 241 slat shaft of 232; 242 spring for 240;

246 slat cover of 236; 250 legrest to seat pivot point, the second pivot point; 254 hinge, seat section for 234; 258 hinge extension of 234;

260 attaching screw for 258; 264 seat to backrest pivot point, the first pivot point; 268 hinge, seat section for 238; 272 hinge extension of 238;

274 attaching screw for 272; 276 pins of 254, 258, 268, 272;

278 side member of 234; 280 side member of 236; 282 side member of 238;

283 horizontal leg of structural angle of 282; 284 front crosspiece of 236;

286 rear crosspiece of 236; 288 leaf chain;

291 foot board of 234; 293 head board of 238; 294 guide block of 236.

296 rocker arm of 30; 304 rocker extension arm of 296

306 ground engaging member of 30; 308 crosspiece of 306.

DESCRIPTION OF THE PREFERRED EMBODIMENT

Although the preferred embodiment functions both as a chair and as a bed, nomenclature generally used with a chair is employed in specification and claims to provide a systematic form of description, but not to limit the inventive concept as it relates to a bed. Since the two sides of the chair are, with few exceptions, of identical construction, the following description and reference numbers only are given with reference to one side of the chair unless otherwise noted. The sides of the chair are parallel. In the following description when a Figure reference is enclosed in parenthesis, the reader's attention is called to that Figure for that one part alone.

FIGS. 1 and 2 illustrate the assembly of the present invention as a chair and rocking chair respectively, and in FIG. 3 the assembly has been adjusted to function as a bed. Frame 30 comprises transport assembly 132 having downwardly positionable front legs 170 and rear legs 32 with crosspieces 200, 82 attached to them, and having ground engaging devices connected to the legs 170, 32 such as rocker arms 296, wheel assemblies 40 and casters 228. Platform 232 secured atop transport assembly 132 has portions comprising legrest 234, seat 236 and backrest 238. A plurality of wood-like slats 240 are closely spaced from head to foot of platform 232 on pairs of coil springs supported by platform members 278, 280, 282 so that the occupant is continuously supported thereby. For occupant comfort it is preferably that a thin layer of a pliable but firm plastic or similar material be located perpendicularly with respect to and over the slats and a thin layer of foam cushion be placed over the plastic surface. Platform members 278, 280, 282 can be adjustably moved through a range of positions about pivots represented diagrammatically in FIG. 4 to define a variety of chair and bed arrangements. Levers 108 support back member 282 and are affixed to rear legs 32. A legrest structural angle crosspiece (not shown) is attached to and between the two legrest side members 278 at their foot end, and a foot board is attached to the exterior edge of crosspiece for appearance. Similarly a backrest crosspiece (not shown) is attached to and between the two backrest side members 282 at their head end, and head board 293 is attached to the exterior crosspiece edge for appearance. As shown in FIGS. 3 and 4 the legrest 234, seat 236, and backrest 238 may be oriented into a substantially coplanar relationship to serve as a bed.

A detailed description of the various components of the assembly will now be given by referring to FIG. 5, and to the other FIGS. 6 to 11 in conjunction with FIG. 5.

In the chair or bed-like position, the top of rear leg 32 is secured between parallel inside 134 and outside 136 plates at the rear of transport assembly 132. The upper section 36 of the rear leg hinge is fastened to and between parallel plates 134, 136 in such fashion that leg 32 is pivoted into the slot bordered on three sides by upper hinge section 36 and the two plates 134, 136. leg 32 is held in position by stabilizing screw 78 through inside plate 134 and bolted into axle 76. As the legs are outwardly sloping, leg 32 also is held in position by the inward pivotal force on upper hinge section 36. To facilitate being shipped and stored, wheel assembly 40 is retracted, stabilizing screw 78 is released, and leg 32 is adapted to be pivoted to rest along and under transport assembly 132 into a folded position (not shown).

Figure 8:
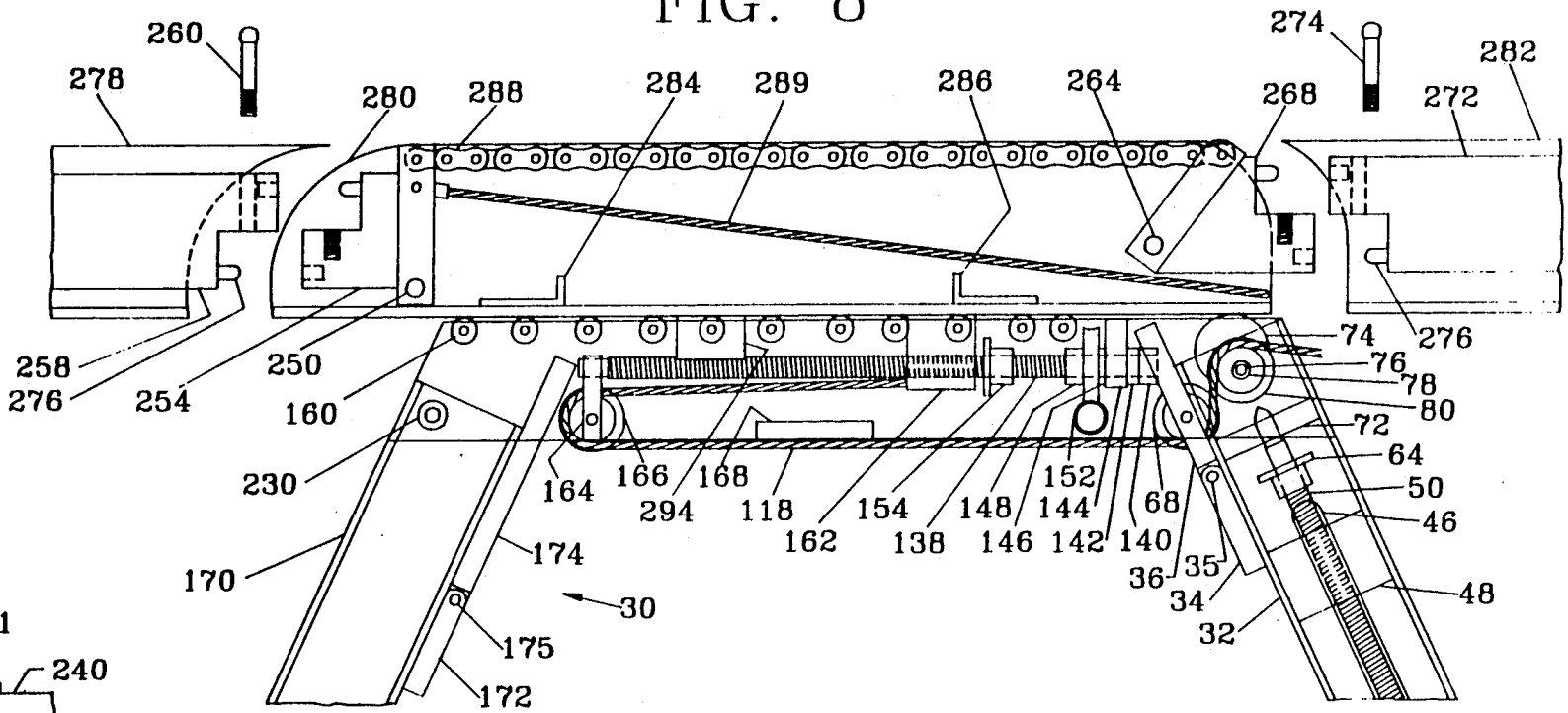
FIG. 8 is a distal view of transport assembly, a portion of front and rear legs, and cable path showing leaf chain linkage between legrest and backrest and an exploded view of legrest and backrest being removed from seat.

Similarly at the front of transport assembly 132, upper section 174 of the front leg hinge is fastened between parallel plates 134, 136 in such fashion that front leg 170 is pivoted into the slot bordered on three sides by the upper hinge section 174 and plates 134, 136. In FIG. 8 leg 170 is held in position by stabilizing screw 230 and by an inward pivoted force analogous to force exerted on rear leg 32. At the top of leg 170 sufficient space is provided to permit seat guide block 294 to pass above leg 170. In the folded position stabilizing screw 230 is released and leg 170 is adapted to be pivoted to rest along and under folded rear leg 32 and its attached lever 108. Lever 108 may be detached to create a more compact folding.

Figure 7:
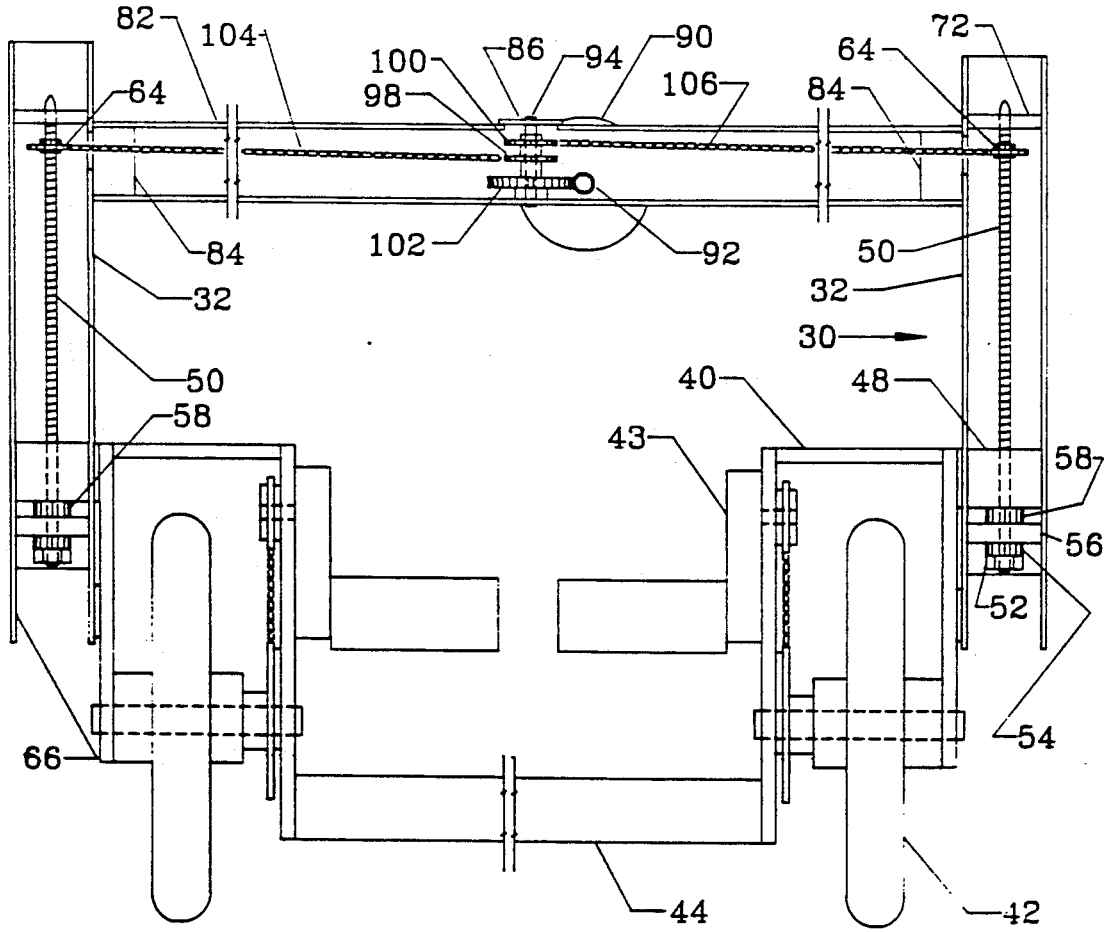
FIG. 7 is a rear view of rear leg assembly and attached wheel assembly.

As is shown in FIG. 7 crosspiece 82 is fastened at the upper portions of and between rear legs 32 to form together the rear leg assembly. An insert 84 is bolted to crosspiece 82 and legs 32 to firmly join them. On the inward side of and to the right, left, or center of crosspiece 82 is attached a reversible motor 90 with worm 92 attached to its shaft. Within crosspiece 82 an axle 94 is attached to upper 100 and lower 98 chain sprockets and to a worm gear 102 meshing with motor worm 92. Axle 94 is rotatably connected to a cover plate 86 at one end and rotatably connected at the other end to crosspiece 82. Cover plate 86 provides access to the assembly. The assembly comprising 94, 100, 98, and 102 is rotated by motor 90. Rotational speed is reduced at worm gear 102 and movement is transferred synchronously via chains 104, 106 to sprockets 64 attached to threaded shafts 50. The chains pass through grooves in crosspiece inserts 84 and in the side of legs 32. At either end of threaded shaft 50 mounting blocks 56, 72 are bolted to legs 32 and are rotatably connected to threaded shaft 50. On the underside of the lower mounting block a thrust bearing 54 provides a bearing surface between mounting block 56 and nut 52. A retaining nut 52 attached to shaft 50 prevents upward movement of threaded shaft 50. Collar 58 attached to shaft 50 prevents downward movement of shaft 50.

Figure 5:
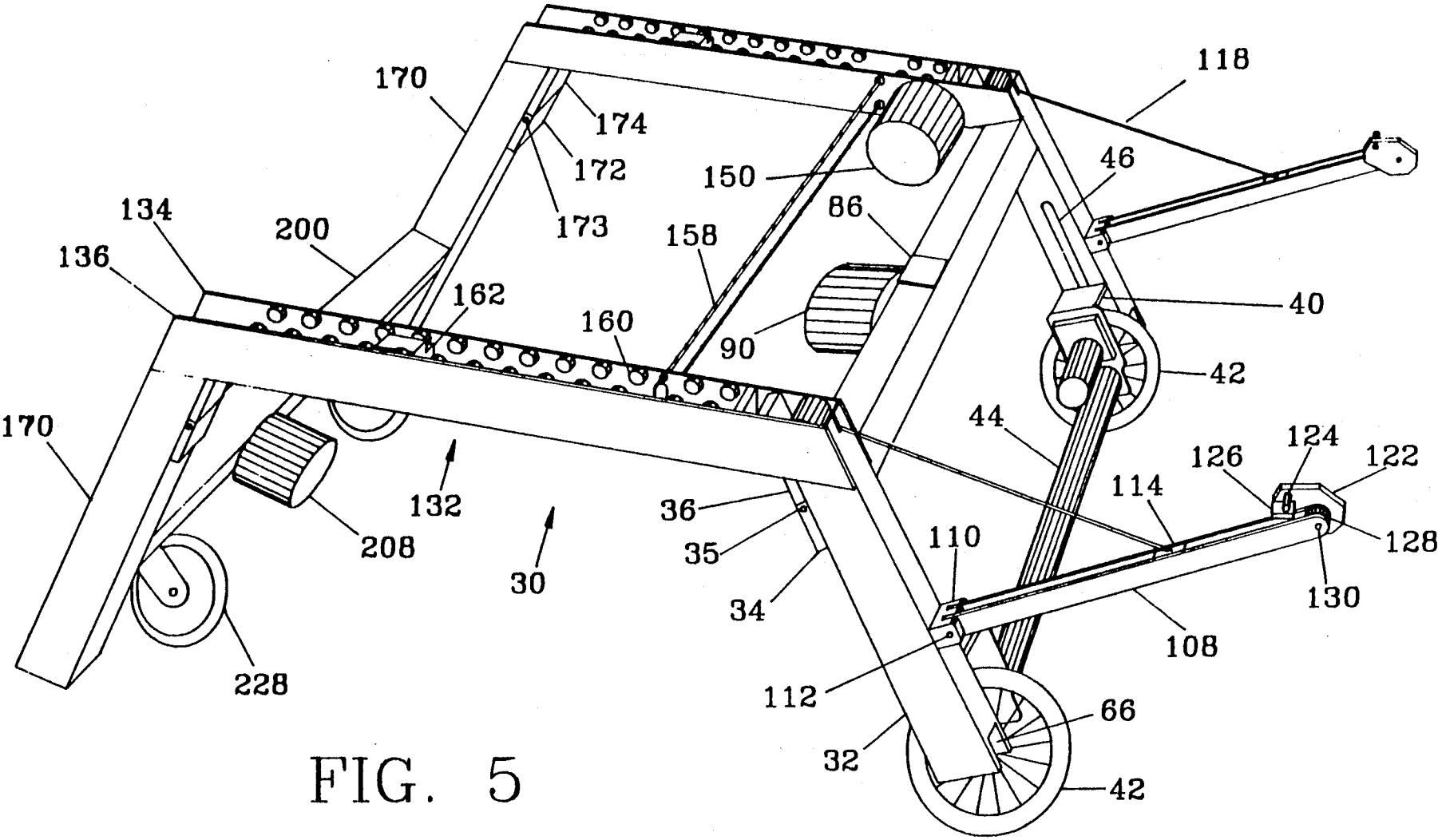
FIG. 5 is a perspective elevated view of frame with platform removed.

Referring to FIGS. 7 and 5, the threaded center hole of slide block 48 is positioned longitudinally with respect to leg 32. Slide block 48 protrudes through leg slot 46. Shaft 50 threadedly engages with slide block 48 to provide linear motion. As is preferred, threaded shaft 50 is in tension when loaded. Wheel assembly 40 is fastened to the portion of the slide block 48 protruding through leg slot 46 and has a lower guide sliding within slot 46 that provides rigidity to extended wheel assembly 40. By running motor 90 in the desired direction, the position of wheel assembly 40 can be adjusted.

FIGS. 5, 7 and 8 wheel assembly 40 is so constructed that assembly crosspiece 44 in conjunction with rear leg crosspiece 82 provide rigidity and lateral support for rear legs 32. Crosspieces 44 and 82 together with front leg crosspiece 200, seat crosspieces 284, 286, and legrest and backrest crosspieces provide strength and stability. Sea guide block 294 and seat block 162 transfer rigidity from platform 232 (FIG. 2) to frame 30.

Figure 6:
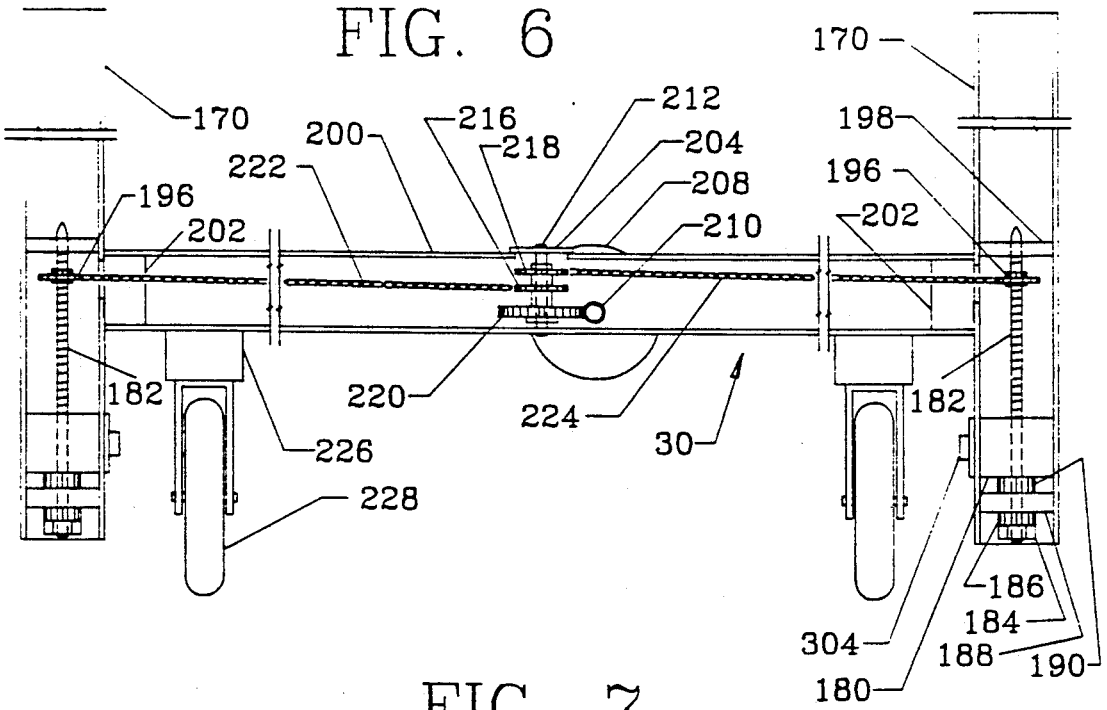
FIG. 6 is a front view of front leg assembly and attached casters.

Referring now to FIG. 5 and 6, front leg 170 is constructed and functions much as rear leg 32 does. Crosspiece 200 is fastened at the lower portion of and between front legs 170 to form together the front leg assembly. Frame design and front leg crosspiece 200 in particular allows for use of a motorized commode mechanism attached under the seat. It is important that crosspiece 200 be sufficiently low to permit a commode to pass over it. As can be seen particularly in FIG. 5, but with reference also to FIG. 1, there is a region forwardly of chain 158 in which a commode mechanism securable beneath seat 280 may move forwardly and rearwardly with seat 280 thus defining an unobstructed commode-receiving region in communication with the seat. Additionally crosspiece 200 must be sufficiently low that the commode mechanism can lower the commode and move it to the side without interference from crosspiece 200.

An insert 202 is bolted to crosspiece 200 and legs 170 to join them. On the inward side of and to the right, left, or center of crosspiece 200 is attached a reversible motor 208 with worm 210 on its shaft. Within crosspiece 200 is located an axle 212 attached to upper 218 and lower 216 chain sprockets and to a worm gear 220 meshing with motor worm 210. Axle 212 is rotatably connected to a cover plate 204 at one end and rotatably connected at the other end to crosspiece 200. Cover plate 204 provides access to the assembly. When the assembly comprising 212, 216, 218, and 220 is rotated by motor 1208, it drives chains 222, 224 and consequently turns sprocket 196 and attached threaded shaft 182. At either end of the threaded shaft 182 mounting blocks 188, 198 are bolted to legs 170 and are rotatably connected to threaded shaft 182. As with rear leg 32 (FIG. 7), shaft 182 threadedly engages with slide block 180 to provide linear movement.

As is preferred, threaded shaft 182 is in tension when loaded. On the underside of lower mounting block 188, shaft 182 runs through a thrust bearing 186 and is attached to retaining nut 184 which prevents upward movement of threaded shaft 182. Downward movement of shaft 182 is prevented by collar 190 thereof abutting mounting block 188. On front leg 170 casters 228 are mounted via mounting blocks 226 attached to crosspiece 200.

In FIG. 2 rocker arm 296 is demountably connected within longitudinal aperture 66 (FIG. 5 and 7) at the bottom of the rear leg 32. A mounting block (not shown) fixedly attached to and above the rocker 296 is fitted within an end aperture of leg 32 and is detachably bolted to leg 32 by a fastener on the front side of the leg. rocker 296 is loosely connected within aperture 66 of rear leg 32 so that it may pivot in response to front leg rocker adjustments. On front leg 170 slide block 180 (FIG. 6) protrudes through leg slot 178. On the inside edge of the front of rocker 296, a slidably connected extension arm 304 is attached to slide block 180. Slide block 180 may be adjusted to extend or retract the front end of rocker 296 and to thereby adjust seat angle according to the occupant's needs. Rocker 296 is retracted before the chair is driven in the wheelchair position.

Referring again to FIGS. 5 and 8 and with reference to longitudinal frame members shown therein the framework of the transport and support assembly 132 comprises two parallel plates 134, 136. Each of these plates is located to either side of and bolted to rear leg upper hinge section 36, to transport mounting block 144, to support block 168, to front transport mounting block 164, and to front leg upper hinge section 174. These parts 36, 144, 168, 164, and 174 serve as crosspieces between plates 134, 136 giving transport assembly 132 great strength. A plurality of rollers 160 with self contained axles are closely spaced along inward portions of plates 134, 136 and the axles are press fitted into holes in plates 134, 136 such that seat member 280 and back member 282 are fully supported and move on rollers 160 without contacting plates 134, 136.

Figure 9:
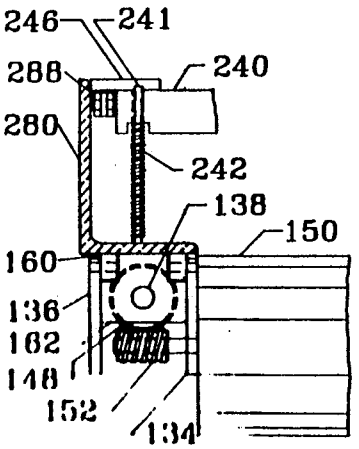
FIG. 9 is a cross sectional view of transport assembly, spring supported slat, and related items.

The following are on shaft 138: a slotted nut 140 attached to shaft 138, a thrust bearing 142, a rear mounting block 144 to shaft 138 is rotatably connected, a spacer 146, a worm gear 148 attached to threaded shaft 138 and meshing with worm 152 on shaft of motor 150, a chain sprocket 154 attached to threaded shaft 138 and linked to its counterpart 154 on the other side via a chain 158 running through holes on inside plates 134, a seat block 162 with a hole threadedly engaging with shaft 138, and front mounting block 164 to which shaft 138 is rotatably connected. In FIG. 9, motor 150 is mounted to inside plate 134 and its shaft passes through a hole in plate 134. Motor 150 and its corresponding worm 152 and worm gear 148 may be attached to both right and left inside plates 134. As one motor 150 is usually sufficient to drive shaft 138, motor 150 is mounted on one side only in the preferred embodiment. Such configuration does not preclude use of motors on both sides.

Also in FIG. 9 seat block 162 has two longitudinal slots with a depth slightly exceeding the diameter of rollers 160. The maximum width of the seat block is slightly less than the distance between plates 134, 136. With seat member 280 detachably connected to seat block 162, the seat block is trapped. It cannot move laterally due to plates 134 and 136 or vertically due to rollers 160 between seat member 280 and seat block 162. In FIG. 8 a guide block 294 is mounted on the underside of seat 280 as far forward as can be contained within plates 134 and 136 (FIG. 5). Guide block 294 is trapped by rollers 160 and guides seat 280 much as seat block 162 is guided. Front mounting block 164 and guide block 294 are sufficiently short and shaped such that guide block 294 passes over mounting block 164 without interference.

In FIGS. 5 and 8 when motor 150 is actuated, its speed of rotation is reduced at worm gear 148 and synchronously transferred to opposing threaded shaft 138 via sprocket 154 and chain 158. Shaft 138 turning through its mating surface in seat block 162 moved this block linearly. As is preferred, threaded shaft 138 is in tension when loaded. The seat member 280 is movably connected to frame 30 such that seat 280, its attached block 162, and the corresponding platform 232 move forward or rearward to change chair configuration. Seat block 162 serves as the component adjustably connected to the support assembly. As represented diagrammatically in FIG. 4, longitudinal movement of seat 280 and platform is required to control the location of the center of gravity.

In FIG. 8 pulley 166 is mounted within a grove in front mounting block 164 where block 164 attaches to the inside transport assembly plate. Alternatively pulley 166 may be mounted within a grove of front leg hinge plate 174 and shaft 138 may be rotatably connected to the hinge plate 174 also, instead of using mounting block 164. One end of cable 118 is fastened to seat block 162, and cable 118 is routed around front pulley 166, under hinge pulley 68 which is mounted in a slot in the center of rear leg upper hinge 36, and over pulley 80 contained in rear leg pulley cap 74. Slots are provided on the front and backside of rear leg 32 through which hinge pulley 68 and/or cable 118 pass. In FIG. 5, the other end of cable 118 is detachably connected to lever 108 at its connecting block 114. In FIG. 8 the method of routing cable 118 is a desirable one which keeps the cable largely out of view. Pulley cap 74 is held in position by axle 76 which runs through the inside wall of leg 32 and is bolted to outside wall of leg 32. Pulley cap 74 and its axle 76 serve several functions: they captivate cable 118 between hinge pulley 68 and cap 74 so that it remains in position whether the chair is in use or is folded. The upper surface of the pulley cap 74 provides support for backrest 238 when it is fully reclined. And axle 76 is threaded such that stabilizing screw 78 is fastened to it to hold rear leg 32 in position.

With reference to FIG. 5 and as is disclosed in detail in the computer program CHAIRFIT of FIGS. 12 and 12A, the length of lever 108, the mounting point for lever 108 on rear leg 32, the location of connecting block 114, and the movement of cable 118 are specifically determined based on sex, heights and weights of occupants using a designated frame 30 size. The lower end of the lever 108 is mounted and pivots at such a determined mounting point on leg 32. Mounting block 110 has two slots pivotally connected to the two plates which are the longitudinal members of lever 108 and are parallel. Connecting block 114 is between and attached to the two plates of 108. At the upper end of lever 108, a rotatably connected roller 128 supports back member 282 in all backrest positions. Cable 118, in tension, links movement and position of seat block 162 and lever 108.

In FIG. 5 and more particularly in FIG. 10, axle 130 which supports roller 128 extends inwards and is pivotally connected to brake 122 comprising a substantially vertical section affixed to two closely spaced protrusions 124, 126 neat the pivot point. In FIG. 10 Upper protrusion 124 extends above the lower and horizontal leg of backrest structural angle member 283 of backrest 238 and forward of the pivot point. Lower protrusion 126 extends beneath member 283 and forward of the pivot point. Protrusion 126 shows a rubber-like surface facing the structural angel 283. When a force other than that applied by lever 108 attempts to quickly raise back member 283, brake protrusions bind on the back member 283 and prevent back member 283 from rising. When force is removed, lower protrusion 126 drops and back member 282 moves freely with respect to the lever. The brake 122 is shown in the disengaged position in FIG. 10.

Referring to FIG. 9, slat shafts 241 are press fitted into members 278, 280, 282 and are slidably connected through coil springs 242 to slats 240 in order to guide the movement of slats 240 in a substantially perpendicular direction in relationship to respective members 278, 280, 282. Near either end of slat, shafts 241 are locked so that the slat may move upward and downwards on shaft 241 in response to the load placed on slats 240. Slat covers 246 overlapping slats are bolted through columns (not shown) between slats to respective side members. Slat covers 246 limit upward movement of slats. As disclosed in more detail in CHAIRFIT, spring rate values for springs 242 are determined by specific formulas. As indicated in CHAIRFIT and Table C, amount of deflection occurring specific segments and load on the segments varies as chair position changes.

Referring now to FIG. 8, the lower leg of structural angle seat member 280 and back member 282 and their slidably supported slats meet rearward of the first pivot point 264. In a practical embodiment of the invention the distance between pivot point 264 and the rear of seat member 280 is 2.75 inches and slats 240 are 1.5" wide. Thus in this area one or more occupant supporting slats are usually placed. When backrest 238 moves upward it effectively shortens the exposed top of the seat. With an adequately rearward of pivot point 264 meeting, the bottom of seat member 280 is thus longer than the exposed seat when back member 282 is in the upright position. Increased length at the bottom of seat member 280 makes possible a longer transport assembly 132 and consequently a wider wheel base. Increased wheel base provides additional stability particularly in the horizontal position. Such meeting point also slightly moves the center of gravity forward in the upright backrest position.

The side of the legrest member 278 mating with seat member 280 is cut on an arc forward to the second pivot point 250. Hinge extension 258 is bolted to the vertical side of leg member 278. A cutout in the bottom of seat member 280 allows hinge elements 254, 258 to lower.

In FIG. 8, hinge extension 272 is bolted to the vertical side of back member 282. Both hinges at the seat to legrest second pivot point 250 and the seat to backrest first pivot point 264 are similarly constructed such that the opposing hinge extensions 254, 268 at the outside of the respective pivot points 250, 264 are detachably joined to hinge sections 258, 272. Hinge extension sections 258, 272 and hinge seat section 254, 268 are firmly connected for normal use by removable vertical attaching screws 260, 274 and by fixed horizontal pins 276 juxtaposedly press fitted into one section and freely fitting into the opposing mating section. The mating sections are "L" shaped 254, 268 and inverted "L" shaped 258, 272. The respective hinge sections 254 and 258, 268 and 272 may be disconnected by removing attaching screws 260, 274 to disassemble leg 278 and back 282 member from seat 280. Hinge blocks (not shown) are respectively bolted to seat member 280 and pivotally connected by axle to hinge set sections 254, 268 for leg 278 and back 282 members respectively. It can thus be seen that legrest 234 is pivotally connected at second pivot point 250 directly to the seat and is devoid of direct linking means to frame 30. The backrest is pivotally connected at first pivot point 264 to the seat 236.

In FIG. 8, hinge seat segments 254, 268 are pivotally connected to opposite ends of leaf chain 288: such that when all platform members 276, 280, 282 are connected and the backrest is horizontal, the legrest is also horizontal; such that the connecting point of chain 288 is at a sufficient distance from hinge pivot points 250, 264 that stress on the parts remains within safe limits; and such that at the moment when the legrest reaches its lowest point, it is approximately parallel to the backrest. By such connection the position of leg member 278 position is responsive to movement of back member 282 and moves approximately concurrently with it. On the seat to back section of hinge 268 the connecting point of leaf chain 288 is rearward of hinge first pivot point 264 to accommodate chain length on which male leafs are at equal 1" increments. Chain 288 serves as a linking mechanism between the backrest 238 and legrest 234.

The use of aluminum structural angle for the sides of the leg 278, seat 280, and back 282 members serves many purposes including: it provides great strength for overhung loads; it shields mechanical mechanisms from view; it is light weight; it can be anodized a variety of colors; and it is of sufficient strength that devices and structural members can be attached to it. It is anticipated that medical devices or aids that the occupant may desire will be attached to these sides.

In a practical embodiment of the invention the following were used: 6063-T5 rectangular aluminum tube $1\frac{1}{2} \times 2 \times 0.125$" was used in rear legs 32, crosspieces 82, 200 and front legs 170. A permanent magnet 12 VDC motor, 2350 RPM, 12 oz. in. torque was used for motors 90, 150, and 208. 6061-T6 aluminum structural angle 3×2×3/16" was used in leg members 278, seat member 280, and back member 282. Yellow pine slats 240 were approximately 1.5" wide. Slat shafts 241 were made from ⅛" diameter 304 stainless steel. Seat block 162 and slides 48, 180 were made from self lubricating acetal plastic. Rollers 160 are approximately 29/64 in diameter. The rearward of pivot point meeting was 2.75" from the first pivot point 264. Coil springs 242 had an outside diameter of approximately 0.30" and were 2.5" long. leaf chain 288 had a plate height of 0.41" and ultimate strength of 4,000 lbs.

The following abbreviated description of the computer program CHAIRFIT lists computer line numbers and functions performed or items calculated at that point. The computer program illustrates the inventive portion of the process of manufacture. Male and female data are handled separately throughout. Of the 42 "X" values, the first 21 are male. The next 21 are female. For ease of understanding when line numbers are read alone, they should be read as nouns, in most cases as the subject of the sentence. The program is listed and disclosed in FIGS. 12 and 12A. In part the program discloses the manner and process of making the present invention.

The program discloses the method for determining matrix values: M(X,6), seat length; M(X,7), legrest length; M(X.9), backrest length; M(X,15l), seat movement; M(X,28), backrest spring rate; and M(X,29), seat spring rate. To determine spring rates the program uses matrix values: M(X,12), occupant's weight and V(29), mounting distance between slats.

Lines 40-70 set variables, open heading file, and print headings. 80-90 set print format and dimension arrays. 100-460 set variables used in body of program. Sample data is listed under REM DATA for input statements for purposes of example and may be changed by the manufacturer to reflect more representative data. Representative data is defined to be realistic and appropriate anthropometric, design, and statistical data. Variables varying widely from this data may reveal program errors requiring debugging by programmer of normal skill or require that more appropriate data be inputted. It also is possible to modify this program without departing from its inventive concept to obtain slightly different outputs. 100-240 input anthropometric percentile data describing anticipated user population. 250-280 input variables related to chair construction. 290 defines print using variables. 300-330 input average male weights. 340-360 input average female weights. 370-380 set printout headings. 390-460 input the number of standard deviations occurring within a specified percentile range.

The body of the program consists of lines 470-2740. These lines comprise formulas and systematic process of operation such that the same results will be produced when the same user provided variables inputted prior to the body of the program. Lines 500-520 compute four estimates of standard deviations male and female, below and above the 50% mark. These four estimates are not true standard deviations but figures that provide a more accurate estimate of the population than the two true standards of deviation would. To compute sizes for key body measurements for population as a whole, lines 530-560 use first +50% estimates and then −50% estimates for males and females together with the designated number of standard deviations within a specified percentile range. This data is stored in array M(42, DD) such that if the first coordinate is 21 or less, it refers to male data; and such that if it is greater than 21, it refers to female data.

Line 580 computes preliminary platform length based on occupant height plus clearance at head and foot. 590-620 round off distance between legrest to seat pivot point 250 (FIG. 8) and seat to backrest pivot point 264 (FIG. 8) to next lowest step or value approximating present value less desired seat overhang and less backrest spring deflection. The distance between seat pivot points hereafter is abbreviated to "seat pivot". A seat that is slightly too short is preferable to one that is too long. 630-660 set top of frame length to equal a determined value plus overlap less desired overhang. 670-700 round off legrest to next highest step or value approximating present value. 710 determines longest legrest for a frame size. 720 determines the longest legrest for a frame size within a range, for example for females only. Legrest length is from pivot point 250 (FIG. 8) to foot board 291 (FIG. 3). 725 repeats process with range redefined. 730 sets backrest to equal preliminary platform less eat pivot length less legrest length. 740-770 round off backrest to next highest step or value approximating present value. 780 standardizes longest backrest to frame size. 790 standardizes backrest within a range. Backrest length is length from pivot point 264 (FIG. 8) to head board 293 (FIG. 3). 795 repeats process with range redefined. In 800 if the flag is set to 1 then standardized back and legrests are used for a specific frame size; otherwise, previously determined leg and backrests are employed. It is considered preferably to have the flag set to 1. In either case the program will specify discrete segment sizes to be manufactured. 810 sets platform length to sum of backrest, seat pivot, and legrest. 820-830 standardize armrest to backrest by averaging.

840-930 determines movement required to reach the center of gravity in the horizontal platform position. Male and female computations are performed separately. "M" variable prefix denotes male; "F" denotes female. 840-compute head and neck weight. 860 sets trunk, arms, and hands weight. 860-870 determines trunk weight per inch and slat weight per inch. 870 sets head weight plus slat weight. 880 sets one half occupant weight plus slat weight. 890 computes above occupant weight plus slat weight less head plus slat weight and distance from top of head to center of gravity. 900 sets distance from center of gravity to head of platform. 910-920 determines movement required to move center of gravity equidistantly between legs. 930 standardizes movement.

940-950 determine platform height based on longest front leg used with frame. 970-1000 determine maximum movement to extend and retract rear leg wheel assembly based on that wheel mount length, rear leg length, and front leg length to the ground. The actual front leg length is shorter and does not come in contact with the ground. Casters mounted to its crosspiece or ground engaging devices connected to its slide 180 (FIG. 6) contact the ground.

1010-1050 determine lever length through subroutine 2320 and select from a variety of levers determined in 2330. 2320-2410 set lever angle. That angle determines mounting point distance from top of leg, which also is equal to cable connecting point on lever. From this lever length is calculated. Lever length is then selected based on total overhang supported by lever, rear leg length, and connecting point position on lever.

1060-1280 calculate percentage of discretely sized chair segments manufactured. 1060-1130 designate segment: legrest, seat pivot, backrest, or frame and clear matrix. 1140 sets lengths of segments. 1140-1200 set difference between lowest percentile and 0, augment percent or store as required for males then females, store male data via subroutine 2230, and store female data via subroutine 2270. Subroutine 2150 prints percent of each size to be manufactured. Examples of such printouts are indicated in Table A. 1210 sets total percent manufactured of each size. 1220-1240 sort total, highest to lowest. 1260-1270 determine amount of structural angle used. Similar techniques to determine totals of other material that are size dependent may be adapted to program. 1280 repeat for next segment.

The section 1290-1660 by means of general trigonometric relationships estimates average loads on different chair segments. At points of pronounced curves in body or of rigid bone-like structure loads will diverge from stated averages. 1290-1430 determine weight of body sections. 1440-1460 determine, at specified backrest angle, desired spring rates for backrest, seat, and legrest via subroutine 2000. 2010 computes weight borne by footrest. 2020 calculates weight borne by armrest. 2030 determines weight transferred from head, trunk, and arms to seat and armrest. 2040 determines weight transferred in rocking, weight supported by back segment, load supported by seat, and load supported by legrest. 2040-2060 set spring rate for backrest, spring rate for seat, and spring rate for legrest. 1470-1660 prints values at a variety of backrest and legrest angles. 1630-1660 indicates spring deflection at different angles.

In 1670-1750 seat angle is determined based on a quadrilateral dividend into two adjacent triangles. Calculations are based on the law of cosines, the law of sines, and equivalent trigonometric expressions. Front leg extension is an arbitrary figure for purposes of example. In practice it may vary with leg length.

This routine, 1760-1850 does not account for varying contact points on lever roller 128 (FIG. 5) with back member 282 (FIG. 1) due to diameter of roller or account for seat to backrest pivot 264 (FIG. 8) being located above frame top, but does disclose general relationships between component parts. 1770 sets horizontal distance from leg 32 (FIG. 5) to lever pivot point 112 and sets vertical distance from pivot point to horizontal platform 232, 1780 determines horizontal distance from a line parallel with leg 32 and intersecting pivot point 112 (FIG. 5) to a point on horizontal platform 232 vertical to the pivot point. 1780 calculates total horizontal distance from seat to backrest pivot 264 (FIG. 8) to lever 108 contact point with platform. 1790 prints headings for movement, backrest angle, vertical distance from lever contact point to horizontal line coplanar with the top 160 (FIG. 5) of frame, horizontal distance from seat to backrest pivot 264 (FIG. 8) to lever contact point with back member 282 (FIG. 1). 1800 steps through cable movement. 1810 determines cable length and cosine of angle of intersection between lever 108 (FIG. 5) and line parallel to leg 32 (FIG. 5). 1820 converts cosine to equivalent tangent expression and finds angle. 1830 finds vertical distance to lever contact point above horizontal line intersecting with lever pivot point/axle 112 (FIG. 5). 1840 determines horizontal distance from backrest pivot point to vertical line intersecting lever contact point and determines vertical distance above top of frame line to lever contact point point. It also determines backrest angle.

1860-1960 prints data, transfers data to disk for use by other programs, and sorts data based on height in part to illustrate the necessity of accounting for the sex of the occupant when customizing such a chair.

DESCRIPTION MODE OF OPERATION

Not precluding exterior use, the present invention is especially suited for use within the home. As retracting the rocker arm 296 and extending rear wheel assembly 40, or vice versa, is easily accomplished, the chair allows one to easily drive about within or between rooms and convert to a rocking, sitting, or a reclined position as desired.

In commercially available wheelchairs, whether self propelled or motor driven, 4.5" to 7.5" of total width of the device is customarily consumed by wheels, drive system, or drive controls. This constitutes is a full 18% to 30% of total chair width. The present invention places wheels 42 within the frame area under the chair and uses hand held controls. Such design makes more efficient use of space and provides increased mobility and occupant comfort.

Referring to FIG. 4, coordinated and simultaneous motorized movement of leg member 278, the center of gravity and back member 282 allows the occupant to select a sitting or reclined backrest position with confidence that the chair will be comfortable and stable in all backrest positions, that seat level will remain at substantially the same height, and that movement between positions will be smooth and infinitely adjustable.

This coordinated movement is made possible by an interrelationship between lever 108 position and seat member 280 position. The seat member 280 is linked to back member 282 via a first class pulley 166 (FIG. 8) and cable 118 mechanism and a third class lever 108 providing greatest mechanical advantage when the back member 282 is substantially horizontal and the load is the greatest and the least mechanical advantage when the back member 282 is substantially vertical and the load least. The linkage thus provides a variable mechanical advantage for raising the backrest. Such a linkage makes it possible to raise back 282 with a low rotating force. As illustrated in FIG. 4 a nonlinear relationship exists between the angular position of the back member 282 and seat member 280 movement.

As the seat member 280 moves rearward, the lever 108 and its roller 128 (FIG. 5) in contact with the back member 282 pivot forward, thus raising the back member 282. Conversely as the seat member 280 moves forward, the lever 108 pivots rearward due to slackening of cable 118 (FIG. 5). Downward force exerted on the lever 108 by the back member 282, thus lowers back member 282.

With reference to FIG. 3, when the platform 232 is in a substantially horizontal position, platform 282 and its occupant are moved forward such that center of gravity is approximately centered between front 170 and rear 32 legs. The desired amount of movement is determined in CHAIRFIT. In all positions the center of gravity remains within an acceptably small range such that it is possible to use the chair as a rocking chair in all positions, when equipped with rockers 296.

When the seat 236 is in a forward position and the backrest 238 reclined, the overhung load between the lever 108 contact point and the rear most position of back member is less than conventional methods for supporting a back member, since the lever 108 extends far rearward of the seat to backrest pivot point 264. Consequently the backrest 238 is well supported in any position. When the platform 232 is in its forwardmost position, a portion of the backrest 232 rest directly on the frame 30 (FIG. 5), providing additional stability in the horizontal position.

In FIGS. 5 and 8, the cable 118 attached to the lever 108 is in tension. Such a cable is lighter and more stable then lever mechanisms in compression used to support back members in may reclining chairs. The cable mechanism is on underside of the seat, out of the occupant's way.

The leg 278 and back 282 members are linkably connected by leaf chain 288 such that as back member 282 raises, the leg member lowers; and such that, conversely, as back member 282 lowers the leg member raises. Because of the strength of leaf chain 288 the radius at the attaching points about the front and rear seat pivot points may be small enough to be contained within the aluminum angle sides. The chair of the present invention may optionally include an adjustable cable for limiting movement of leg member 278 which limits the downward movement of the leg member when back raises.

When the downward movement of the legrest 234 is limited or when the legrest 234 is nearly horizontal, retracting rear wheel assembly 40 to increase the angle of seat 236 also raises the legrest 234. Such an elevated legrest is frequently prescribed for patients, particularly those with poor circulation.

In FIG. 5 and 10, to prevent reclined back member 282 from inadvertently raising when downward pressure is applied to a raised leg member 278, a brake 122 is attached to roller 128 assembly on lever 108. This brake 122 stabilizes chair configuration when occupant exits and enters the chair and when reduced weight may be on reclined back member 282 and additional weight may be on leg 278.

The method of detaching leg 278 and back 282 members leaves all linkages for raising and lowering back members 282 either in the seat 236 or in the frame 30. This facilitates disassembly for shipping, repair, or customizing. Construction of leg 234 and back 238 rests preferably involves a minimum number of discrete parts and is thus well suited for customization.

Referring to FIGS. 1 and 2, wheel assembly 40 is slidably and adjustably attached to the interior of short rear legs 32. When wheel assembly 40 is extended, the wheels 42 are in contact with the ground and seat 236 is horizontal. In the retracted position rear wheels 42 are partially removed from sight and out of the way. In this position a short rear leg 32 supports the chair. As the rear leg 32 is shorter than the front one 170, the angle of seat 236 is instantly increased as is preferable for occupant comfort. By the use of motorized control the angle of seat 236 can be further adjusted by extending or retracting the point at which the front of rocker arm 296 are attached to the front legs to respectively increase or decrease seat angle.

FIGS. 6 and 7 reveal many similarities. With the exception of the lengths of threaded shafts 182 and 50, the majority of drive train components on the front and rear legs are identical. Likewise their functions are identical. FIG. 6 shows the slide 180 with an adjustably positioned ground engaging rocker. FIG. 7 shows an identical slide 48 with an adjustably positioned ground engaging wheel assembly. The functions of these legs 32, 170 are to extend and retract ground engaging components. Other embodiments of the invention may effectively employ these slides to extend and retract ground engaging components other than those previously shown. One such example shown in FIG. 11 adjustably positions a ground engaging leg member 306 on either a front or rear leg assembly. Such a member can be additionally equipped with a caster, or casters may be mounted on the crosspiece of the member 306.

With reference to FIG. 5, to permit movement required by bed pan/commode elements: no transverse support pieces or other items exist on the upper portion of the frame 30 forward of the rearmost location of the bed pan so that seat 236 and its attached commode mechanisms may move within the seat's range of motion without obstruction. The crosspiece 200 on the front leg 170 is located sufficiently low that it does not obstruct commode movement. All motors 90, 208 on crosspieces 82, 200 attached to legs 32, 170 may be located near the legs so as not to obstruct commode mechanisms.

From consideration of FIG. 5 and previous description of the frame 30 and attached parts, the reader will note that the frame is one of very minimal, light-weight, and uncluttered construction. The economy of frame design is characterized by: a minimum number of crosspieces 44, 82, 200; moving parts contained within the structural components 32, 82, 170, 200, 132 of the frame; loaded moving parts 50, 118, 138, 182 in tension rather than compression, outward sloping legs 32, 170, and only a pair of longitudinal support members 132. To have a frame that has the above characteristics, that folds, that permits use of a motorized drive system, that accommodates use of a mechanized commode mechanism, that extends or retracts a rear wheel assembly 40, that extends or retracts rocker arm 296 (FIG. 2) at front leg attachment point, that extends and retracts a variety of ground engaging components, that moves the seat 236 (FIG. 3) rearward or forward, and that raises the backrest 238 (FIG. 2) constitutes a great advantage for the user.

When an occupant's legs in contact with the ground in a conventional rocker, there normally is a limit to how much the seat angle can be increased before the front edge of the seat puts excessive pressure on the underside of the occupant's leg and impedes blood circulation to the leg. Since occupant's legs are supported by a legrest 234 in the present invention, seat 236 angle can be increased more than possible with a conventional rocker with the benefits thereof and not the adverse effect on blood circulation.

As the occupant is fully supported in the present invention, rocking the chair by the usual method of pressing one's foot to the ground is impossible. An electrically controlled mechanism shifts a weight on the underside of the seat to rock the chair. With such a mechanism the rate of rocking, the degree of motion, and the intervals at which rocking occurs can be controlled by known means.

The process of manufacture includes a plurality of computer steps for computing the lengths of component parts and determining the quantity of each of these to manufacture. This process is of sufficient commplexity that it requires four and a half minutes of continuous computer computation before first results are printed. The processes of manufacturing and assembly then involve machining and assembly of parts by known techniques to bring these parts to completion such that customized chairs are produced.

The reader's attention is directed to Tables A, B, and C, all of which are interrelated and are illustrative printouts of CHAIRFIT based on data shown in lines 140–450. FIGS. 12 and 12A lists mnemonics and definitions for headings in Tables A and B.

Table B illustrates 42 chair configurations that precisely fit 21 makes and 21 females ranging in size from the 99.5 percentile to the 0.5 percentile. Table A indicates the proportionate quantities of discrete chair segments manufactured. Table C indicates the load, and corresponding spring deflection, on chair segments.

In the specific case illustrated in Table B CHAIRFIT indicates the size of a customized chair for the individual. In the general case shown in Table A it indicates the proportional quantity of segments of discrete length that need be manufactured. Without such advanced knowledge of the proportional quantity required, customization is a matter of happenstance wholly unsuited for mass production.

Factors in the ordinary instance that make customization unpredictable are: females on average are 5" shorter than males, approximately 45% of females of the same height as males require a longer seat, and the unknown quantity of people of various heights using such chairs. CHAIRFIT overcomes these problems and provides a systematic process of customization for large or small scale production.

Table A refers to four components and percentage of each manufactured: the seat, frame, legrest, and backrest. SIZE refers to component length. FEMALE refers to percent of females using the size segment. MALE refers to percent of males using that size segment. TOTAL refers to the combined percentage of males and females using the segment. CUM indicates the cumulative sum of previous TOTALS.

In Table A the distance between seat pivot points is shown to be 17.5" in the first case with 33.05% of the population using that size seat. In the second case it is 16.5" with 30.65% using this seat and 63.7% using the 17.5" and 16.5" seat. Upon further examination of table A the reader will find 7 SEATPV and FRAME sizes, 9 LEG (legrest) sizes, 8 BACK (backrest) sizes, and the TOTAL proportional quantities of each required to meet the needs of the total population. Even in those instances where the individual user requires different size segments than those computed, such deviations tend to be normally distributed and don't affect total quantities manufactured.

By way of example Table A shows that no seat fits more than 33% of the population. This implies that unless the reader is one of the fortunate 33%, the chair in which the reader now sits probably doesn't fit and is apt to be stressing the musculoskeletal system. The need for customization is an imperative in a device that not only supports the seat but supports the entire body for prolonged periods.

Where Table A indicates the general case, Table B indicates the specific. Percentiles, occupant height in feet and inches, average occupant weight, and related chair data are shown first for 21 males and then 21 females. FRAME, LEG, SEATPV, and BACK, refer to the same items as in Table A, but apply to individuals of specific height and sex. PLAT is the total platform length and the sum of LEG, SEATPV, and BACK. With customization using length segments indicated under these headings, 30 distinct chairs can be assembled to precisely fit the 42 representative individuals of heights and sex as indicated. By setting the flat V(40) to equal 1 when running CHAIRFIT, the same size seat may also be manufactured for use with a longer leg and back rest standardized to seat size. In such case 13 different chairs would fit the 42 individuals, with the segments being L-LEG, SEATPV, L-Back and their sum equaling L-PLAT. The usable area in the longer legrest can be effectively shortened by moving the footrest upwards. The overage with the longer backrest illustrated seldom exceeds 1". Either the normal or long leg and backrest option will produce a custom fit of equal comfort. The longer leg and backrest option is considered preferred because of each of sizing the chair for the occupant and the fewer number of resulting chair models. Table A shows leg and backrest quantities manufactured based on this option under headings L-LEG and L-BACK.

Table B shows spring rates for people of average weight used for backrest, seat, and legrest: SPR-B, SPR-S, SPR-L respectively. Since weights vary widely with respect to height, springs need to be inserted prior to use based on occupant weight and be available in various ranges, for example based on 70%, 85%, 100%, 115%, 130% of average weight.

The spring rates printed in Table B are related to Table C. Table C reflects estimates of loads at a variety of backrest angles. B/G ANGLE refers to backrest to ground angle; B/S ANGLE, to backrest to seat angle. BACKREST refers to perpendicular load on backrest. ROCK refers to difference between previous and present backrest load thus indicating effect of rocking. BK BASE indicates load transferred from trunk to seat, most of which is born by the base of the back. ARMREST, SEAT, LEGREST ad FOOTREST indicate loads on these respective components. Loads are indicated in pounds. DEF BACK, DEF SEAT and DEF LEG refer to the average spring deflection under slats in the stated regions.

For the average 140 lb woman spring rates of 2.63, 4.42, and 1.10 lbs./in. are shown in Table B for backrest, seat, and legrest respectively. With the same springs used in Table C, the reader will note that at an intermediate angle of 45 degrees the average deflection in backrest, seat, and leg are equal and that within the total range of backrest angles deflection remains within a desirable range. The process used by CHAIRFIT to compute spring rates, makes it possible and desirable to employ springs and slats to support an occupant in a wide variety of positions. Such a process produces a materially different result than previous implementations of springs and slats to support an individual in a single position.

As additionally demonstrated in Table C when a chair tilts, the load on the lower back is reduced and support provided by the backrest increases substantially. Table C suggests that one of the advantages of rocking, which principally is a rhythmic repeated tilting action, is that it shifts the load within the body onto the backrest. In the case of a woman of average height and weight rocking from 70° to 60 degrees, a full 14.2 lbs load would be shifted rhythmically to and from the backrest. In the case of the average man it would be 17.8 lbs. Such action on the musculoskeletal system conforms to the requirements of good chair design and suggests therapeutic advantages for many back and other health problems.

The load bearing characteristics of arm and foot rest are shown in Table C. Footrest and armrest assist in adjusting and changing body position. reduce the tendency to slouch down in a chair, and better support the body by reducing the load on base of the back and seat.

A correct selection of springs 242 and slats 240 (FIG. 9) as provided for in CHAIRFIT tends to meet Dr. Travell's requirements that: seating devices should be designed so that as the muscles relax and the body tends to sag, correct posture is maintained by the chair and not by muscle work; muscle fatigue and joint strain are thus avoided.

Dreyfuss also has noted that deep soft cushions allow the ischia to sink too far and the load is then transferred to surrounding flesh creating discomfort and rotating the greater trochanters of the thigh bone causing tension i the hip muscles. Slats which provide transverse support to the body prevent rotation and thus preclude this effect. In the event spring 242 force were too soft to support the slat 240, the slat would bottom out and sinking more deeply would be thus prevented.

In addition to their ability to contour to and support the occupant, springs 242 and slats 240 have other attributes: A thin light weight surface consisting of slats 240 makes packing, shipping, and storage easier. For shipping leg and back rests can be overlapped since there is a void between slats 240 and their supporting member. Facilitating customization and assembly, slats 240 may be used interchangeably in nearly all chair segments.

In FIG. 8, the surface created by the slats 240 is a thin one facilitating hinging particularly at the seat member to back member first pivot point 264. A wide cushion at this point would create problems of interference between a seat cushion and back cushion as the backrest changes position. In the present invention a meeting rearward of pivot point 264 by seat 280 and back 282 members and their respective slats 240 makes it possible to raise the backrest slats and thin material or cushions on them without back cushions binding or folding and to still have continuous occupant support when platform is horizontal. A meeting rearward of pivot point 264 assures that the lower portion of the backrest does not put pressure on the coccyx, consistent with good chair design. These are few slats in this region in the upright backrest position. With a meeting rearward of pivot point 264, sides of members 280, 282 are joined on an arc for reasons of function and appearance.

Additionally it is possible to alter spring rates of springs 242 (FIG. 9) in certain areas like the front of the seat 236 edge or to remove a slat 240 to accommodate an injury. With slats 240 providing some changing of air to the underside of the patient, the tendency to build up pockets of contaminated air under the patient is reduced. As slats 240 are removable and not absorbent as is a common mattress, they can be cleaned easily if they are soiled. The surface created by the adjacent slats 240 can be used with or without additional material over the slats.

While preceding descriptions contain many specificities, these should not be construed as limitations on the scope of the invention, but rather as an exemplification of one preferred embodiment thereof. Many other variations are possible which are within the spirit of the invention and the scope of the claims. For example: items that are connected may be held together by other kinds of fasteners of known design; the invention may be used without wheels in a stationary mode by either infirm or healthy persons; various manner of ground engaging devices may be slidably attached to front and rear legs; to aid folding the lever may be detachable, separable into two or more sections, or employ a movable or detachable mounting block; slats may be slidably connected to their shafts by rotating pieces attached at or within their ends; slats may be embedded in cushions or foams of various kinds to provide transverse support; slats of various widths may be employed; the lever need not be straight; leg and backrest may be made to be of adjustable length; the rearward of pivot point meeting may vary between sizes so as to permit the use of one frame size to fit several seat lengths; front or rear legs may be detachable; a variety of electrical controls may be used for positioning seat and ground engaging devices; front legs may be used without an adjustable ground engaging device; if greater security is required due to the particular nature of the patient, support devices may be used in addition to present legs to extend effective wheelbase; a tiltable transport and support assembly pivotable at the rear may be employed to alter seat angle; a pivotable armrest linked to remain parallel with the seat and selectively rotatable so that the occupant can get onto and off of the chair from the side may be employed; armrests may be adjustable so that supporting surface moves inward; linens and cushions of various sizes dimensions and kinds and of assorted methods of connection to chair segments can be used; cushions attachable to back members can be employed to expand the effective width of the chair; and a wide variety of medical, protective devices, or devices for the users benefit such as portable telephones, tables, and the like may be attached to the chair.

TABLE A

| SIZE | FEMALE | MALE | TOTAL | CUM | | SIZE | FEMALE | MALE | TOTAL | CUM |
|---|---|---|---|---|---|---|---|---|---|---|
| | | SEATPV | | | | | | FRAME | | |
| 17.50 | 20.00 | 50.00 | 33.05 | 33.05 | 1 | 19.75 | 20.00 | 50.00 | 33.05 | 33.05 |
| 16.50 | 35.00 | 25.00 | 30.65 | 63.70 | 2 | 18.75 | 35.00 | 25.00 | 30.65 | 63.70 |
| 15.50 | 30.00 | 5.00 | 19.13 | 82.83 | 3 | 17.75 | 30.00 | 5.00 | 19.13 | 82.83 |
| 18.50 | 4.50 | 19.00 | 10.81 | 93.63 | 4 | 20.75 | 4.50 | 19.00 | 10.81 | 93.63 |
| 14.50 | 9.00 | 0.00 | 5.09 | 98.72 | 5 | 16.75 | 9.00 | 0.00 | 5.09 | 98.72 |
| 19.50 | 0.50 | 1.00 | 0.72 | 99.43 | 6 | 21.75 | 0.50 | 1.00 | 0.72 | 99.43 |
| 13.50 | 1.00 | 0.00 | 0.57 | 100.00 | 7 | 15.75 | 1.00 | 0.00 | 0.57 | 100.00 |
| | | LEG | | | | | | BACK | | |
| 18.50 | 40.00 | 17.50 | 30.21 | 30.21 | 1 | 33.00 | 50.00 | 7.50 | 31.51 | 31.51 |
| 17.75 | 30.00 | 2.50 | 18.04 | 48.25 | 2 | 34.00 | 24.00 | 12.50 | 19.00 | 50.51 |
| 20.00 | 3.00 | 35.00 | 16.92 | 65.17 | 3 | 35.00 | 1.00 | 40.00 | 17.96 | 68.48 |
| 19.25 | 7.00 | 20.00 | 12.66 | 77.83 | 4 | 32.00 | 20.00 | 0.00 | 11.30 | 79.78 |
| 17.00 | 17.50 | 0.00 | 9.89 | 87.71 | 5 | 36.00 | 0.00 | 25.00 | 10.88 | 90.65 |
| 20.75 | 0.00 | 20.00 | 8.70 | 96.41 | 6 | 37.00 | 0.00 | 12.00 | 5.22 | 95.87 |
| 21.50 | 0.00 | 4.50 | 1.96 | 98.37 | 7 | 31.00 | 5.00 | 0.00 | 2.83 | 98.70 |
| 16.25 | 2.50 | 0.00 | 1.41 | 99.78 | 8 | 38.00 | 0.00 | 3.00 | 1.31 | 100.00 |
| 22.25 | 0.00 | 0.50 | 0.22 | 100.00 | 9 | | | | | |

TABLE A-continued

| SIZE | FEMALE | MALE | TOTAL | CUM | | SIZE | FEMALE | MALE | TOTAL | CUM |
|---|---|---|---|---|---|---|---|---|---|---|
| | | L-LEG | | | | | | L-BACK | | |
| 19.25 | 20.00 | 25.00 | 22.18 | 22.18 | 1 | 34.00 | 55.00 | 5.00 | 33.25 | 33.25 |
| 18.50 | 35.00 | 5.00 | 21.95 | 44.13 | 2 | 35.00 | 5.00 | 55.00 | 26.75 | 60.00 |
| 17.75 | 30.00 | 0.00 | 16.95 | 61.08 | 3 | 33.00 | 30.00 | 0.00 | 16.95 | 76.95 |
| 20.00 | 5.00 | 30.00 | 15.88 | 76.95 | 4 | 38.00 | 0.00 | 20.00 | 8.70 | 85.65 |
| 20.75 | 0.00 | 20.00 | 8.70 | 85.65 | 5 | 37.00 | 0.00 | 20.00 | 8.70 | 94.35 |
| 21.50 | 0.00 | 19.00 | 8.27 | 93.92 | 6 | 32.00 | 9.00 | 0.00 | 5.09 | 99.43 |
| 17.00 | 9.00 | 0.00 | 5.09 | 99.00 | 7 | 31.00 | 1.00 | 0.00 | 0.57 | 100.00 |
| 16.25 | 1.00 | 0.00 | 0.57 | 99.57 | 8 | | | | | |
| 22.25 | 0.00 | 1.00 | 0.44 | 100.00 | 9 | | | | | |

TABLE C

| B/G ANGLE | B/S ANGLE | ROCK | BACKREST | BK BASE | ARMREST | SEAT | LEGREST | FOOTREST | DEF BACK | DEF SEAT | DEF LEG |
|---|---|---|---|---|---|---|---|---|---|---|---|
| 90 | 90 | 0.0 | 0.0 | 79.2 | 10.5 | 104.1 | 16.1 | 7.4 | 0.08 | 1.05 | 0.80 |
| 80 | 100 | 15.6 | 15.6 | 78.0 | 10.3 | 102.9 | 16.1 | 7.4 | 0.27 | 1.04 | 0.80 |
| 70 | 110 | 15.1 | 30.7 | 74.5 | 9.9 | 99.3 | 16.1 | 7.4 | 0.45 | 1.00 | 0.80 |
| 60 | 120 | 14.2 | 44.9 | 68.6 | 9.1 | 93.8 | 16.4 | 7.0 | 0.62 | 0.95 | 0.81 |
| 50 | 130 | 12.8 | 57.7 | 60.7 | 8.0 | 86.7 | 16.9 | 6.2 | 0.77 | 0.88 | 0.83 |
| 45 | 135 | 5.8 | 63.5 | 56.0 | 7.4 | 82.5 | 17.1 | 5.7 | 0.84 | 0.84 | 0.84 |
| 40 | 140 | 5.3 | 68.7 | 50.9 | 6.7 | 77.9 | 17.3 | 5.2 | 0.90 | 0.80 | 0.85 |
| 30 | 150 | 9.0 | 77.7 | 39.6 | 5.2 | 67.8 | 17.6 | 4.0 | 1.01 | 0.70 | 0.86 |
| 20 | 160 | 6.6 | 84.3 | 27.1 | 3.6 | 56.5 | 17.9 | 2.8 | 1.09 | 0.59 | 0.87 |
| 10 | 170 | 4.0 | 88.4 | 13.8 | 1.8 | 44.6 | 18.0 | 1.4 | 1.14 | 0.48 | 0.88 |
| 0 | 180 | 1.4 | 89.7 | 0.0 | 0.0 | 32.2 | 18.1 | 0.0 | 1.15 | 0.36 | 0.88 |

TABLE B

| % | HEIGHT | WEIGHT | FRAME | LEG | SEATPV | BACK | PLAT | L-PLAT | L-LEG | L-BACK | SPR-B | SPR-S | SPR-L |
|---|---|---|---|---|---|---|---|---|---|---|---|---|---|
| 99.5 | 6' 3.7 | 205.00 | 21.75 | 22.25 | 19.50 | 38.00 | 79.75 | 79.75 | 22.25 | 38.00 | 3.38 | 5.52 | 1.17 |
| 99.0 | 6' 3.0 | 199.00 | 21.75 | 21.50 | 19.50 | 38.00 | 79.00 | 79.75 | 22.25 | 38.00 | 3.32 | 5.41 | 1.16 |
| 97.5 | 6' 2.0 | 194.00 | 20.75 | 21.50 | 18.50 | 38.00 | 78.00 | 78.00 | 21.50 | 38.00 | 3.27 | 5.34 | 1.15 |
| 97.0 | 6' 1.8 | 194.00 | 20.75 | 21.50 | 18.50 | 38.00 | 78.00 | 78.00 | 21.50 | 38.00 | 3.28 | 5.35 | 1.15 |
| 95.0 | 6' 1.2 | 189.00 | 20.75 | 21.50 | 18.50 | 37.00 | 77.00 | 78.00 | 21.50 | 38.00 | 3.23 | 5.26 | 1.14 |
| 90.0 | 6' 0.2 | 185.00 | 20.75 | 20.75 | 18.50 | 37.00 | 76.25 | 78.00 | 21.50 | 38.00 | 3.20 | 5.22 | 1.13 |
| 80.0 | 5' 10.9 | 180.00 | 20.75 | 20.75 | 18.50 | 36.00 | 75.25 | 78.00 | 21.50 | 38.00 | 3.16 | 5.16 | 1.12 |
| 75.0 | 5' 10.5 | 175.00 | 19.75 | 20.75 | 17.50 | 36.00 | 74.25 | 75.25 | 20.75 | 37.00 | 3.09 | 5.05 | 1.10 |
| 70.0 | 5' 10.0 | 175.00 | 19.75 | 20.00 | 17.50 | 37.00 | 74.50 | 75.25 | 20.75 | 37.00 | 3.11 | 5.07 | 1.11 |
| 60.0 | 5' 9.2 | 170.00 | 19.75 | 20.00 | 17.50 | 36.00 | 73.50 | 75.25 | 20.75 | 37.00 | 3.06 | 4.98 | 1.10 |
| 50.0 | 5' 8.6 | 168.00 | 19.75 | 20.00 | 17.50 | 35.00 | 72.50 | 72.50 | 20.00 | 35.00 | 3.04 | 4.97 | 1.09 |
| 40.0 | 5' 8.0 | 166.00 | 19.75 | 20.00 | 17.50 | 35.00 | 72.50 | 72.50 | 20.00 | 35.00 | 3.03 | 4.95 | 1.09 |
| 30.0 | 5' 7.3 | 163.00 | 19.75 | 19.25 | 17.50 | 35.00 | 71.75 | 72.50 | 20.00 | 35.00 | 3.01 | 4.93 | 1.09 |
| 25.0 | 5' 6.9 | 162.00 | 18.75 | 19.25 | 16.50 | 35.00 | 70.75 | 70.75 | 19.25 | 35.00 | 3.01 | 4.93 | 1.09 |
| 20.0 | 5' 6.4 | 157.00 | 18.75 | 19.25 | 16.50 | 35.00 | 70.75 | 70.75 | 19.25 | 35.00 | 2.94 | 4.82 | 1.07 |
| 10.0 | 5' 5.3 | 153.00 | 18.75 | 18.50 | 16.50 | 34.00 | 69.00 | 70.75 | 19.25 | 35.00 | 2.91 | 4.80 | 1.07 |
| 5.0 | 5' 4.4 | 149.00 | 18.75 | 18.50 | 16.50 | 33.00 | 68.00 | 70.75 | 19.25 | 35.00 | 2.88 | 4.76 | 1.06 |
| 3.0 | 5' 3.8 | 147.00 | 17.75 | 18.50 | 15.50 | 34.00 | 68.00 | 68.00 | 18.50 | 34.00 | 2.86 | 4.74 | 1.06 |
| 2.5 | 5' 3.6 | 147.00 | 17.75 | 18.50 | 15.50 | 34.00 | 68.00 | 68.00 | 18.50 | 34.00 | 2.87 | 4.76 | 1.06 |
| 1.0 | 5' 2.6 | 145.00 | 17.75 | 17.75 | 15.50 | 33.00 | 66.25 | 68.00 | 18.50 | 34.00 | 2.87 | 4.78 | 1.06 |
| 0.5 | 5' 2.0 | 145.00 | 17.75 | 17.75 | 15.50 | 33.00 | 66.25 | 68.00 | 18.50 | 34.00 | 2.89 | 4.84 | 1.07 |
| 99.5 | 5' 10.1 | 169.00 | 21.75 | 20.00 | 19.50 | 35.00 | 74.50 | 74.50 | 20.00 | 35.00 | 2.89 | 4.60 | 1.17 |
| 99.0 | 5' 9.4 | 164.00 | 20.75 | 20.00 | 18.50 | 35.00 | 73.50 | 73.50 | 20.00 | 35.00 | 2.83 | 4.52 | 1.15 |
| 97.5 | 5' 8.5 | 162.00 | 20.75 | 20.00 | 18.50 | 34.00 | 72.50 | 73.50 | 20.00 | 35.00 | 2.83 | 4.56 | 1.15 |
| 97.0 | 5' 8.3 | 160.00 | 20.75 | 20.00 | 18.50 | 34.00 | 72.50 | 73.50 | 20.00 | 35.00 | 2.81 | 4.52 | 1.14 |
| 95.0 | 5' 7.7 | 160.00 | 20.75 | 19.25 | 18.50 | 34.00 | 71.75 | 73.50 | 20.00 | 35.00 | 2.83 | 4.58 | 1.15 |
| 90.0 | 5' 6.8 | 156.00 | 19.75 | 19.25 | 17.50 | 34.00 | 70.75 | 70.75 | 19.25 | 34.00 | 2.79 | 4.56 | 1.14 |
| 80.0 | 5' 5.7 | 152.00 | 19.75 | 18.50 | 17.50 | 34.00 | 70.00 | 70.75 | 19.25 | 34.00 | 2.76 | 4.55 | 1.14 |
| 75.0 | 5' 5.3 | 148.00 | 19.75 | 18.50 | 17.50 | 33.00 | 69.00 | 70.75 | 19.25 | 34.00 | 2.71 | 4.48 | 1.12 |
| 70.0 | 5' 4.9 | 148.00 | 18.75 | 18.50 | 16.50 | 34.00 | 69.00 | 69.00 | 18.50 | 34.00 | 2.72 | 4.52 | 1.13 |
| 60.0 | 5' 4.1 | 141.00 | 18.75 | 18.50 | 16.50 | 33.00 | 68.00 | 69.00 | 18.50 | 34.00 | 2.63 | 4.39 | 1.10 |
| 50.0 | 5' 3.6 | 140.00 | 18.75 | 18.50 | 16.50 | 33.00 | 68.00 | 69.00 | 18.50 | 34.00 | 2.63 | 4.42 | 1.10 |
| 40.0 | 5' 3.1 | 140.00 | 18.75 | 17.75 | 16.50 | 33.00 | 67.25 | 69.00 | 18.50 | 34.00 | 2.65 | 4.47 | 1.11 |
| 30.0 | 5' 2.3 | 136.00 | 17.75 | 17.75 | 15.50 | 33.00 | 66.25 | 66.25 | 17.75 | 33.00 | 2.61 | 4.42 | 1.09 |
| 25.0 | 5' 1.9 | 136.00 | 17.75 | 17.75 | 15.50 | 33.00 | 66.25 | 66.25 | 17.75 | 33.00 | 2.62 | 4.45 | 1.10 |
| 20.0 | 5' 1.5 | 133.00 | 17.75 | 17.75 | 15.50 | 32.00 | 65.25 | 66.25 | 17.75 | 33.00 | 2.59 | 4.40 | 1.09 |
| 10.0 | 5' 0.4 | 130.00 | 17.75 | 17.00 | 15.50 | 32.00 | 64.50 | 66.25 | 17.75 | 33.00 | 2.57 | 4.41 | 1.08 |
| 5.0 | 4' 11.5 | 127.00 | 16.75 | 17.00 | 14.50 | 32.00 | 63.50 | 63.50 | 17.00 | 32.00 | 2.55 | 4.41 | 1.08 |
| 3.0 | 4' 10.9 | 127.00 | 16.75 | 17.00 | 14.50 | 31.00 | 62.50 | 63.50 | 17.00 | 32.00 | 2.57 | 4.46 | 1.09 |
| 2.5 | 4' 10.7 | 127.00 | 16.75 | 17.00 | 14.50 | 31.00 | 62.50 | 63.50 | 17.00 | 32.00 | 2.58 | 4.48 | 1.09 |
| 1.0 | 4' 9.8 | 125.00 | 16.75 | 16.25 | 14.50 | 31.00 | 61.75 | 63.50 | 17.00 | 32.00 | 2.58 | 4.52 | 1.09 |
| 0.5 | 4' 9.1 | 123.00 | 15.75 | 16.25 | 13.50 | 31.00 | 60.75 | 60.75 | 16.25 | 31.00 | 2.56 | 4.51 | 1.09 |

I claim:

1. A reclining chair device comprising:

a frame including a plurality of legs providing support for the front and rear of said frame;

a seat movably connected to the frame:

means secured to said frame for applying substantially linear movement to the seat wherein said means is defined by the frame and constrains seat movement in a substantially linear direction therealong such that the seat is guided longitudinally along the frame thereby permitting the seat to be guided at generally the same height as it is moved forwardly and as it is moved rearwardly;

a backrest pivotally connected at a first pivot point to the seat such that the angular position of said backrest with respect o the seat is adjustable and such that the backrest moves longitudinally with the seat;

a legrest pivotally connected at a second pivot point to the seat wherein the angular position of said legrest with respect to said seat is adjustable wherein the legrest is movable longitudinally therewith and wherein the legrest is devoid of direct supporting linking means to the frame to adjust the angular position of the legrest with respect to the seat;

a platform comprising the seat, the legrest, and the backrest, wherein said platform is supported by the frame and wherein structural members of the frame supporting said platform are substantially on the underside of the uppermost portions of the platform in all backrest positions from a fully reclined backrest position to a fully raised backrest position thereby facilitating ingress and egress;

means secured to at least one of said legrest and said backrest to orient the legrest, the seat, and the backrest into a substantially coplanar relationship such that the reclining chair device may be used as a bed;

means connected to one of said frame and said seat for altering the angel of the seat with respect to the horizontal thereby allowing the occupant to be more comfortable; and means for raising and lowering the backrest wherein said means for raising and lowering the backrest support the backrest in all backrest positions are substantially located beneath the uppermost portions of the backrest in all backrest positions, wherein the angular position of the backrest with respect to the seat is infinitely adjustable between backrest positions, wherein as the seat moves rearwardly the backrest raises, wherein said means for raising and lowering the backrest is secured to at least one of said seat and said frame, wherein as the seat moves forwardly the backrest reclines thereby moving an occupant of said chair forwardly as the backrest reclines, and wherein the center of gravity is moved forwardly as the backrest reclines.

2. A device of claim 1 wherein a third class lever having first and second ends, the first end being pivotally secured at one end to the frame at a location below the seat and the second end supporting the backrest, said lever being linkably connected at a point intermediate to first and second ends of said lever to said set to provide a means for raising said backrest as said seat moves rearwardly.

3. A chair device comprising:

a frame comprising a plurality of longitudinal frame members to which front and rear legs are attached;

a seat supported by said longitudinal frame members and movably connected thereto by means to permit forwardly and rearwardly movement with respect to said frame;

a backrest pivotally connected at a first pivot point to the seat, wherein the angular position of said backrest with respect to the seat is adjustable and wherein the backrest is movable forwardly and rearwardly with the seat; and a third class lever, wherein a power is defined as being between a fulcrum and a resistance, wherein said third class lever supports the backrest and is pivotally connected at said fulcrum to the frame and is linkably connected to the seat, wherein said power is located between the fulcrum and said resistance provided by the backrest and wherein the power is provided by said linkable connection between the third class lever and the seat, wherein lever movement is responsive to seat movement, wherein the linkable connection between the third class lever and the seat provides a means of sufficient strength to support the backrest in all backrest positions from a sitting position to a fully reclined position, wherein the linkable connection at the point of connection with the third class lever is substantially in tension, wherein the third class lever provides a means for raising the backrest as the seat moves rearwardly wherein as said first pivot point moves rearwardly, the third class lever pivots forwardly thus raising the backrest, and contrariwise as the first pivot point moves forwardly, the third class lever pivots rearwardly thus allowing the backrest to lower, thereby creating an interrelationship between seat position, lever position, and angular position of the backrest with respect to the seat, and thereby also moving an occupant of the chair and the center of gravity forward as the backrest reclines which contributes to chair stability in a reclined backrest position.

4. A device of claim 1 or 3 further comprising means contained within the structural components of a said leg for extending and retracting a ground engaging component adjustably connected to the leg.

5. A device of claim 1 or 3 wherein a plurality of closely spaced springably supported transverse slats provide an occupant-supporting means.

6. A device of claim 1 or 3 wherein the occupant supporting sections of said seat and said backrest meet rearward of said first pivot point.

7. A device of claim 1 or 3 wherein a ground engaging component is adjustably connected to a said leg such that when said component is ground engaged and movably adjusted, the angle of the seat with respect to the horizontal is altered.

8. A device of claim 2 or 3 wherein a backrest brake comprising a substantially vertical section affixed to two protrusions is pivotally connected to said third class lever and is slidably located with respect to said backrest such that an upper protrusion extends above a longitudinal backrest component and such that a lower protrusion extends beneath said backrest component whereby if a force other than said lever attempts to rapidly raise said backrest, said protrusions bind on said backrest component impeding said backrest from rising further.

9. A device of claim 3 further comprising a legrest pivotally connected at a second pivot point to said seat.

10. A device of claim 1 or 9 wherein said legrest and said backrest are detachable from said set thereby permitting removal of said legrest and said backrest.

11. A device of claim 1 or 9 wherein said legrest is linkably connected by a linking mechanism to said backrest such that as said backrest is lowered said legrest rises and as said backrest is raised said legrest lowers, such that said linking mechanism is in tension and is predominantly contained beneath the sides of said seat, and such that the angular positioning of the legrest with respect to the seat is responsive to the angular positioning of the backrest with respect to the seat.

12. A device of claim 9 further comprising means to orient said legrest, said seat, and said backrest into a substantially coplanar relationship such that the device may be used as a bed.

13. A device of claim 1 or 9 further comprising rocker arms connected to the frame wherein longitudinal movement of the seat moves the center of gravity forwardly as the backrest reclines with respect to the seat, wherein the backrest and the legrest can be positioned in a variety of configurations varying from a seated occupant position to a reclined occupant position so that the occupant o the device may rock safely at various backrest positions, thereby permitting a variety of medical benefits to be achieved including but not limited to mechanical ventilation and reduction of musculoskeletal pain.

14. A frame device for a chair with a backrest that reclines as a seat of said chair moves forwardly comprising:

a plurality of longitudinal support assemblies wherein said support assemblies provide support for said seat and wherein a means is provided for moving the seat forwardly and rearwardly with respect too said support assemblies wherein said means comprises a component adjustably connected to a said support assembly and providing a structure to which the seat may be connected such that said support assembly may move the seat forwardly and rearwardly with respect to said frame;

a pair o front legs connected to the support assemblies wherein said front legs are positionable downwardly to provide support for the support assemblies;

a pair of rear legs connected to the support assemblies wherein said rear legs are positionable downwardly to provide support for the support assemblies, said rear legs being jointed by a crosspiece together forming a rear leg assembly such that within structural components of said rear leg assembly are contained means linkably connected between said pair of rear legs to extend and retract ground engaging components adjustably connected to and substantially linearly movable along said rear legs such that retracting and extending said ground engaging components alters the angle of the seat with respect to the horizontal and such that locating said means substantially within the rear leg assembly provides a means for containing on the inside of the rear legs devices used for adjusting the position of ground engaging components adjustably connected to the rear legs; and a plurality of ground engaging components adjustably connected to said pair of rear legs such that when said components are ground engaged and movably adjusted, the angle of the seat with respect to the horizontal is altered thereby providing substantially continuous ground engagement while the angle of the seat with respect to the horizontal is altered.

15. A device of claim 14 further comprising a lever pivotally connected to said rear legs and linkably connected to said component adjustably connected to said support assembly such that said lever serves to provide backrest raising means as the seat moves rearwardly and further provides backrest lowering means as the seat moves forwardly whereby the center of gravity of an occupant supported by the seat tends to move forwardly as the lever pivots rearwardly.

16. A device of claim 14 wherein said front legs are joined by a crosspiece forming together a front leg assembly such that means are substantially contained within the structural components of said assembly to extend and retract ground engaging components connected to the front legs.

17. A device of claim 14 wherein an area forward of the rearmost point of the top of the frame and above the ground surface on which the frame rests remains devoid of any transverse frame component between the right and left hand sides of the frame, said area defining a commode receiving region in communication with the seat and unobstructed in all seat positions.

18. A device of claim 1, 3 or 14 wherein said frame and said rear legs are adapted to permit longitudinally folding said rear legs such that said rear legs are oriented to rest under said frame when folded.

19. A device of claim 1, 3 or 14 wherein said frame and said front legs are adapted to permit longitudinally folding said front legs such that said front legs are oriented to rest under said frame when folded.

20. A device of claim 1, 3 or 14 further comprising ground engaging rocker arms adjustably connected to said front legs and pivotally connected to said rear legs whereby adjusting the positioning of the rocker arms alters the angle of the seat with respect to the horizontal when said rocker arms are ground engaged.

21. A device of claim 1, 3 or 14 wherein a ground engaging wheel assembly is adjustably connected to said rear legs such that retracting said assembly increases the angle of the seat with respect to the horizontal and extending said wheel assembly reduces said angle of the seat, thereby also providing means for moving the chair on wheels when said wheel assembly is extended.

22. A device of claim 1, 3 or 14 wherein an electric motor is employed to extend and retract a ground engaging component connected to a said leg such that extending and retracting said ground engaging component provides means for altering set angle.

23. A device of claim 1, 3 or 14 wherein an electric motor is employed to move said seat longitudinally with respect to said frame.

* * * * *